US006991325B2

(12) United States Patent
Oda et al.

(10) Patent No.: US 6,991,325 B2
(45) Date of Patent: Jan. 31, 2006

(54) INK REPLENISHING DEVICE, SUB INK TANK, AND INK JET RECORDING APPARATUS

(75) Inventors: Kazuyuki Oda, Ebina (JP); Tatsuhiro Ishize, Ebina (JP); Ichiro Tomikawa, Ebina (JP); Katsushi Amarume, Ebina (JP); Takeshi Yoneyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 105 days.

(21) Appl. No.: 10/345,347

(22) Filed: Jan. 16, 2003

(65) Prior Publication Data

US 2004/0001126 A1 Jan. 1, 2004

(30) Foreign Application Priority Data

Jun. 28, 2002 (JP) ..... 2002-190677

(51) Int. Cl.
*B41J 2/175* (2006.01)

(52) U.S. Cl. ..... 347/85

(58) Field of Classification Search ..... 347/30, 347/84, 85, 86; 137/2, 18, 614.2; 277/602, 277/630, 634, 637
See application file for complete search history.

(56) References Cited

U.S. PATENT DOCUMENTS 6,015,209 A * 1/2000 Barinaga et al. ..... 347/86
6,135,590 A * 10/2000 Saeki et al. ..... 347/86
6,299,296 B2 * 10/2001 Gasvoda ..... 347/85
6,416,152 B1 * 7/2002 Matsuzaki et al. ..... 347/19
6,582,068 B2 * 6/2003 Ishizawa et al. ..... 347/85
6,612,683 B2 * 9/2003 Takahashi et al. ..... 347/30

FOREIGN PATENT DOCUMENTS

JP 11-058772 * 3/1999
JP 2000-037879 * 2/2000

* cited by examiner

*Primary Examiner*—Anh T. N. Vo
(74) *Attorney, Agent, or Firm*—Oliff & Berridge, PLC

(57) ABSTRACT

A port for replenishing ink on the side of a main ink tank advances and the nose or tip end of a main body of a pipe enters an ink replenishing opening on the side of a sub ink tank. When a valve body in the main body of the pipe and a valve on side of the sub ink tank are pressed with each other, a communicating port is opened by the valve body. When the main body of the pipe is further inserted into the ink replenishing opening, the valve is separated from a projection portion of a gasket, and a space therebetween starts to be widened. At this stage, as a lip portion of the gasket is not in contact with an outer peripheral portion of the main body of the pipe, an ink channel is opened to the atmosphere, the ink which is remained in or adhered to the outer peripheral portion of the main body of the pipe or an inside of the ink replenishing opening is absorbed into the sub ink tank dye ti a negative pressure in the sub ink tank. Namely, the present invention provides an ink replenishing device which can reliably prevent ink dirt from being caused by ink replenishing and an ink jet recording apparatus which is provided with the ink replenishing device.

20 Claims, 21 Drawing Sheets

INK REPLENISHING DEVICE, SUB INK TANK, AND INK JET RECORDING APPARATUS

BACKGROUND OF THE INVENTION

1. Field of the Invention

The present invention relates to an ink replenishing device for replenishing ink to a sub ink tank of a recording head device and an ink jet recording apparatus having the ink replenishing device.

2. Description of the Related Art

In the ink jet recording apparatus in which an ink droplet is ejected on the basis of image information from a recording head to a recording medium such as paper to record an image, there is a configuration in which the sub ink tank corresponding to each recording head is mounted on a carriage scanning the recording head, various proposals regarding replenishing of ink to the sub-ink tank have been performed.

For example, as shown in FIG. 21, an ink replenishing tank 540, having a tank holder 541 which rotates and descends as a stepper motor is rotated, is disclosed in Japanese Patent Application Laid-Open (JP-A) No. 10-202897. In this structure, a valve 546 having a hole for replenishing the ink, which is held operatively upward and downward by the tank holder 541 and is pressed always downward by a spring 543-2, contacts an ink replenishing opening 547 of an ink tank 516 mounted on a carriage 518. When the tank holder 541 further descends, the valve 546 moves upward in an O-ring 550 press-fitted in a supply opening 549 of an ink bag 548, a plug member 553 held oscillatably by the supply opening 549 of the ink bag 548 is pushed up by the valve 546 in the O-ring 550 portion. This allows the ink in the ink bag 548 to be replenished by a water head pressure depending on a water level of the ink into the ink tank 516 through the valve 546.

However, in the configuration described above, the ink sometimes leaks from vicinities of the ink replenishing opening 547 and the plug member 553 by contacting and separating actions to the ink replenishing opening 547 of the valve 546, movement of the plug member 553, or the like. Particularly, when the plenty of ink replenishment is carried out, the leaked ink is accumulated to become a large quantity, which sometimes caused other portions of the ink jet recording apparatus or paper to be dirty.

SUMMARY OF THE INVENTION

In view of the fact described above, it is an object of the present invention to obtain an ink replenishing device which can surely prevent ink dirt caused by the ink replenishing and an ink jet recording apparatus provided with the ink replenishing device.

According to a first aspect of the invention, there is provided an ink replenishing device which replenishes ink from a main ink tank to a sub ink tank and in which, ink to be supplied to a recording head which ejects an ink droplet to a recording medium on the basis of image information being reservoired in the sub ink tank, comprising: a first connecting member which is provided in the main ink tank; a second connecting member which is provided in the sub ink tank and connected to the first connecting member to constitute an ink channel; a sealing member which brings the first connecting member and the second connecting member into close and sealing contact with each other in a connected state thereof; an opening and closing member which is provided in the second connecting member and able to open/close the ink channel; and opening means for opening the ink channel into the atmosphere by using the opening and closing member in a connecting operation of the first connecting member and the second connecting member.

The first connecting member may be provided directly in the main tank or provided through a tube or a pipe.

In the ink replenishing device, when the first connecting member and the second connecting member are connected to form the ink channel, the ink can be replenished from the main ink tank to the sub ink tank. Because the first connecting member and the second connecting member are closely or sealingly contacted by the sealing member, the ink leak is prevented during replenishing ink.

The opening and closing member is provided in the second connecting member, the ink channel is opened and closed by the opening and closing member. In the connecting operation of the first connecting member and the second connecting member, the ink channel is opened into the atmosphere by the opening and closing member. Generally, in the recording head (so-called ink jet recording head) ejecting the ink droplet to the recording medium on the basis of image information, since a negative pressure is maintained in the sub ink tank, when the ink channel is opened into the atmosphere as described above, the air is sucked into the sub ink tank by the negative pressure, and the ink which remains and adheres to in the vicinity of a connecting part is also sucked into an inside of the sub ink tank. This enables a decrease in an ink leakage near the connecting members and sure prevention of the ink dirt.

According to a second aspect of the invention, the ink channel is opened into the atmosphere by the opening means before the first connecting member and the second connecting member are brought into close contact with each other by the sealing member. As a result, after the ink which adheres to the vicinity of the connecting part is sucked into the sub ink tank, the first connecting member is closely contacted with the second connecting member, and the ink can be supplied from the main ink tank to the sub ink tank.

According to a third aspect of the invention, the opening means comprises a pressed portion which is provided in the opening and closing member and pressed by one of the first connecting member and the sealing member to move the opening and closing member to an opening position in the connecting operation.

According to a fourth aspect of the invention, the opening means comprises a pressing portion which is provided in one of the first connecting member and the sealing member and presses the opening and closing member to move the opening and closing member to a opening position in the connecting operation.

In either of the third and fourth features, the opening and closing member can be formed by a simple structure in which only the pressed portion or the pressing portion is provided.

According to a fifth aspect of the invention, the ink replenishing device having the above-described aspects further includes pressure reducing means for sucking air inside the sub ink tank, to reduce pressure inside the sub ink tank.

Accordingly, as the inside of the sub ink tank is actively pressure-reduced by the pressure reducing means to maintain the negative pressure, the ink replenishing to the sub ink tank or the ink suction from the vicinity of the connecting part can be carried out efficiently.

According to a sixth aspect of the invention, the sub ink tank for supplying the ink to the recording head which ejects the ink droplet to the recording medium on the basis of the image information, the sub ink tank comprising a connecting member which is connected with a main ink tank, in which the ink replenished to the sub ink tank is stored beforehand, to constitute an ink channel; and an ink holding member which is arranged in the vicinity of the connecting member outside thereof.

The main ink tank is connected to the sub ink tank by the connecting member, the ink stored in the main ink tank can be replenished to the sub ink tank.

The ink holding member is arranged in the vicinity of the connecting member outside thereof. Even if the ink is leaked from the connecting member (connecting part of the main ink tank and the sub ink tank), the leaked ink is held by the ink holding member, so that scatter and spread of the leaked ink can be prevented and the ink dirt can be surely prevented.

With respect to the ink holding member, it suffices as long as the ink holding member is able to hold the ink. For example, the ink holding member may be a shape of a container (for example, the shape of a dish or a boat) which can store the ink inside.

According to a seventh aspect of the invention, the ink holding member comprises a porous body which is made of a porous material and able to absorb ink.

It is preferable that the ink holding member includes such a porous body as described above because the ink is stably held by absorbing the ink in the porous body.

According to an eighth aspect of the invention, a sintered body formed by sintering powder of polyolefine resin may be used as the porous body.

According to a ninth aspect of the invention, the porous body may be formed by polyurethane foam.

According to a tenth aspect of the invention, the porous body may be formed by fibrous felt.

According to an eleventh aspect of the invention, there is provided an ink jet recording apparatus comprising: a recording head unit which is provided with the recording head which ejects an ink droplet to the recording medium on the basis of the image information and the sub ink tank in which ink supplied to the recording head is stored; the main ink tank in which the ink replenished to the sub ink tank is stored beforehand; and the ink replenishing device which replenishes ink from the main ink tank to the sub ink tank and has any one of the above-described first to fifth aspects.

According to the ink jet recording apparatus, the ink replenished from the main ink tank to the sub ink tank is ejected as the ink droplet to the recording medium by the recording head, and the image is recorded on the recording medium.

Because the ink jet recording apparatus has the ink replenishing device having any one of the first to fifth aspects, the ink leakage is decreased and the ink dirt can be surely prevented.

According to a twelfth aspect of the invention, the sub ink tank of the ink jet recording apparatus based on the eleventh aspect is the sub ink tank having any one of the sixth to tenth aspects.

The sub ink tank having any one of the sixth to tenth aspects has the ink holding member. Consequently, even in the case that the ink leaks out, the leaked ink is held by the ink holding member, and the ink dirt can be surely prevented.

BRIEF DESCRIPTION OF THE DRAWINGS

FIG. 15A shows the ink replenishing unit corresponding to black ink, FIG. 15B shows the ink replenishing unit corresponding to cyan ink.

FIG. 15A shows the ink replenishing unit corresponding to magenta ink, FIG. 15B shows the ink replenishing unit corresponding to yellow ink.

DETAILED DESCRIPTION OF THE PREFERRED EMBODIMENT

Figure 1:
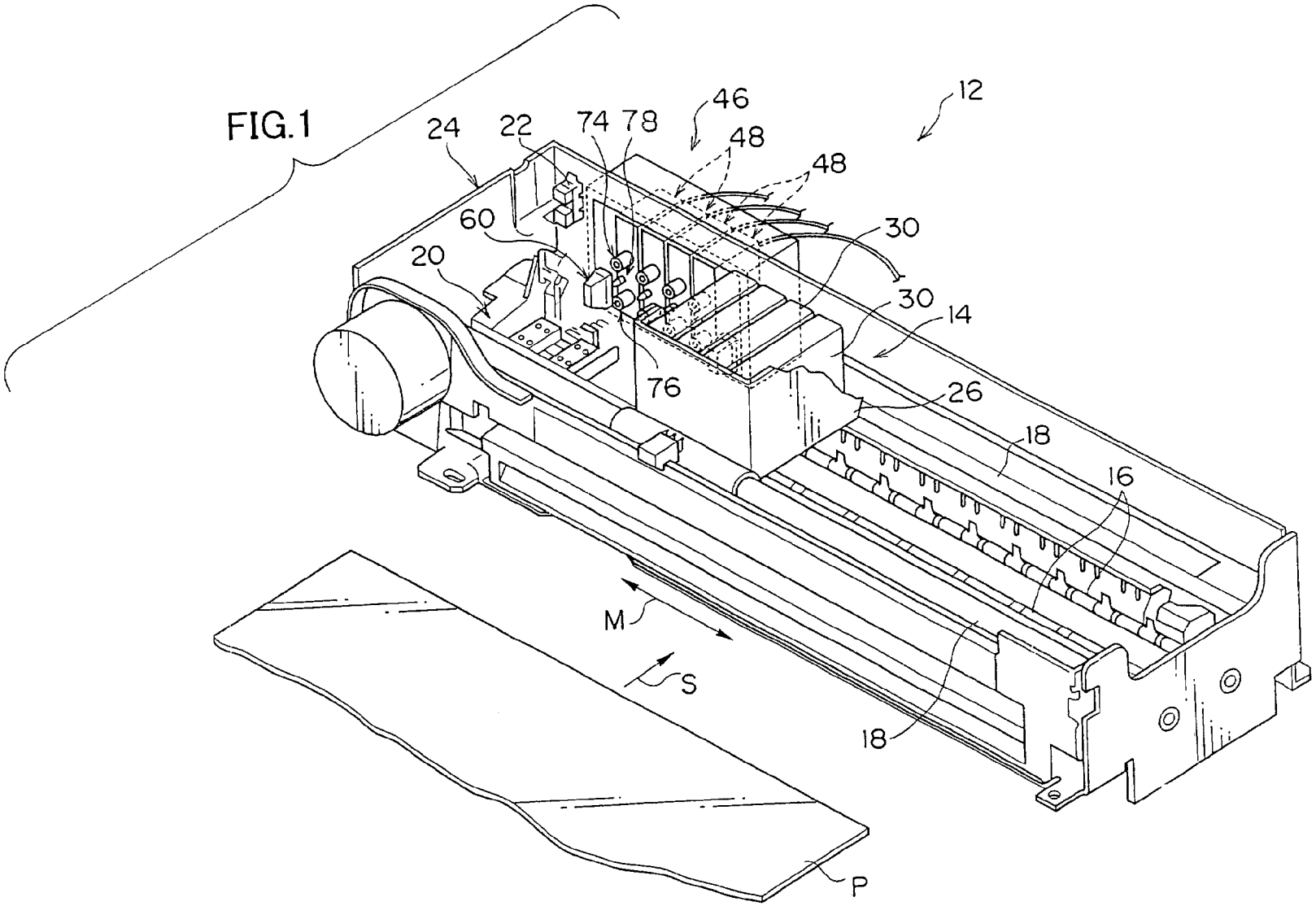
FIG. 1 is a perspective view showing a recording head carriage of an ink jet recording apparatus having an ink replenishing device according to an embodiment of the present invention and the vicinity of the recording head carriage.

FIG. 1 shows an ink jet recording apparatus 12 of a first embodiment of the present invention. Specifically, FIG. 1 shows in enlarged dimension a vicinity of a recording head carriage 14 of the ink jet recording apparatus 12.

The ink jet recording apparatus 12 is provided with a recording medium carrying member 16 which carries a recording medium P (for example, paper and the like) in a fixed direction and a pair of guiding members 18 which is provided along a direction perpendicular to a carrying direction of the recording medium P so as to face a carrying path of the recording medium P. The recording head carriage 14 is supported by these guiding members 18. A maintenance station 20 is placed at a position which is under the guide member 18 and adjacent to the carrying path of the recording medium P, and the maintenance station 20 carries out a maintenance operation such as capping or suction of ink by contacting with and separating from the recording head carriage 14 (in the embodiment, moving upward and downward). The maintenance operation is controlled by a control circuit which is not shown so as to be carried out on predetermined conditions or timing.

A home position of the recording head carriage 14 is set at a position opposite to the maintenance station 20, the position is detected by a position sensor 22. The recording head carriage 14, the recording medium carrying members 16, the guiding member 18, the maintenance station 20, and the position sensor 22 are held by a main body of a housing 24. The image information is transmitted to the recording head carriage 14 through a signal line which is formed on a flexible substrate.

In FIG. 1, a traveling direction of the recording head carriage 14 (main scanning direction) is represented by an arrow M, the traveling direction of the recording medium P is represented by an arrow S respectively.

Figure 2:
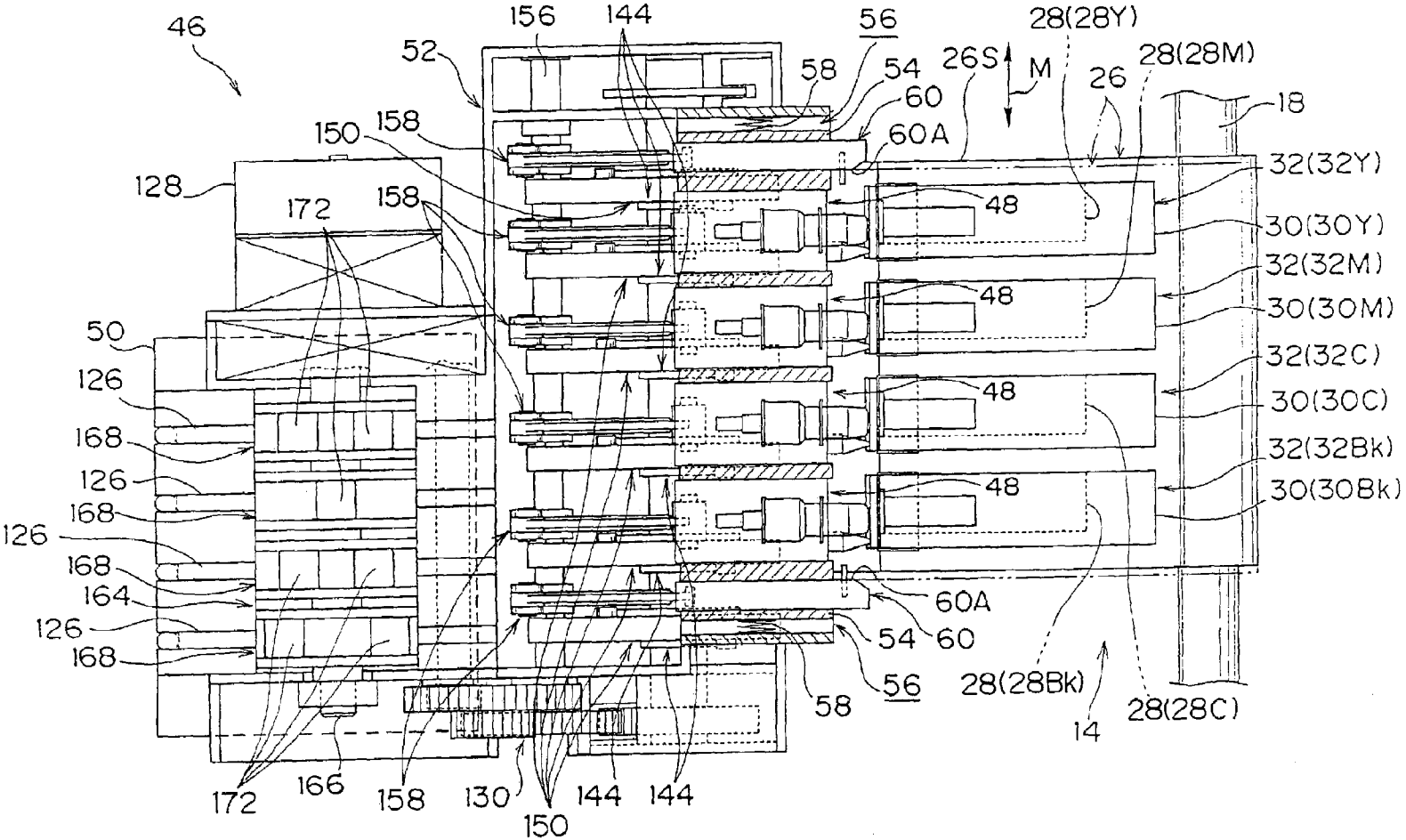
FIG. 2 is a plan view showing an ink replenishing device according to an embodiment of the invention.
Figure 3:
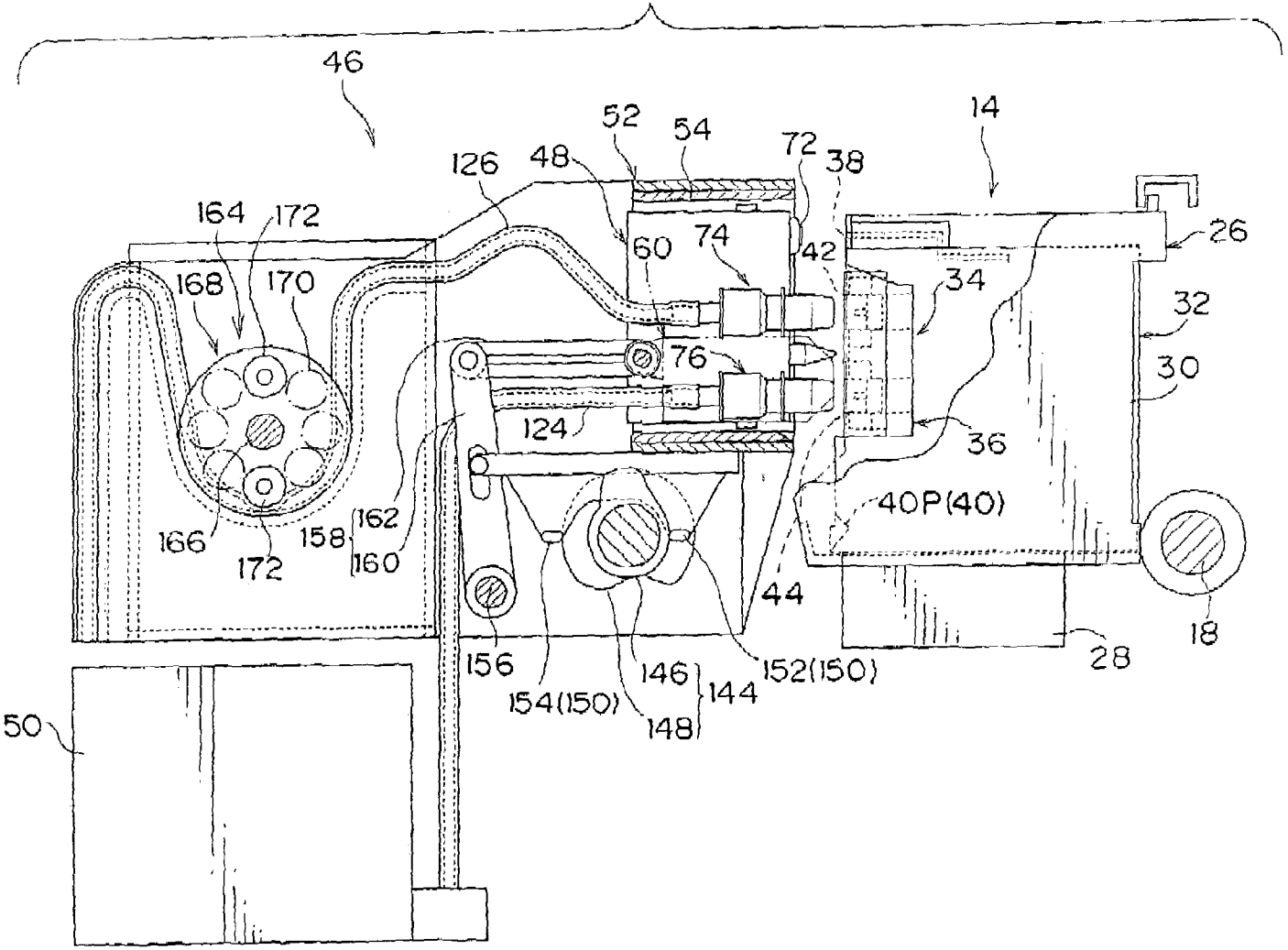
FIG. 3 is a partially ruptured side view showing a schematic configuration of an ink replenishing device according to an embodiment of the invention.
Figure 4:
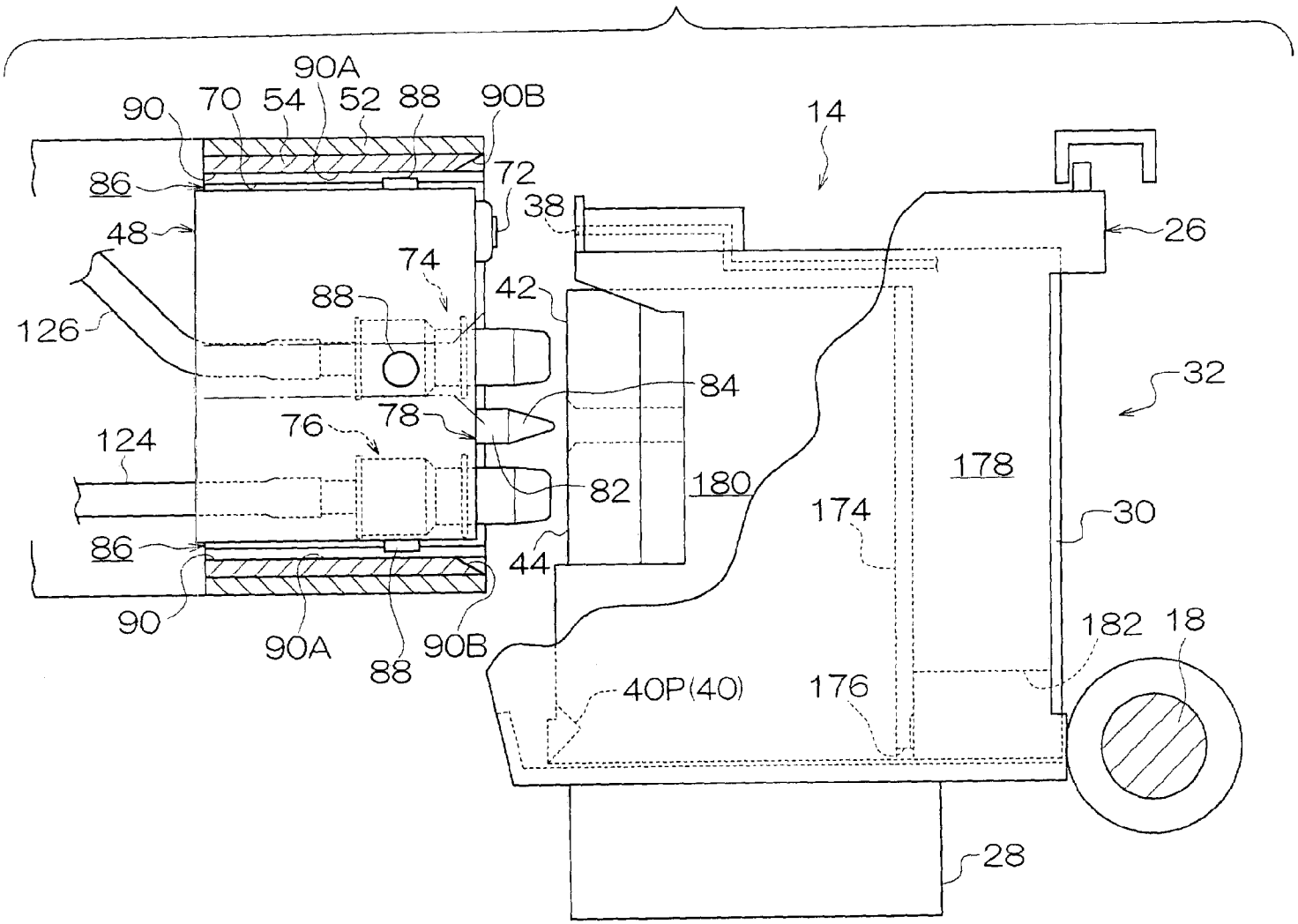
FIG. 4 is a partially ruptured sectional view showing in enlarged dimension an ink replenishing unit of an ink replenishing device and a sub ink tank of an ink jet recording apparatus according to an embodiment of the invention.

As also shown in FIGS. 2 to 4, the recording head carriage 14 includes a recording head carriage frame 26 which is provided movably along the guiding member 18, a plurality of recording heads 28 (in the embodiment, four recording heads) which is provided to project lower than a lower face (a face opposite to the carrying path of the recording medium P) of the recording head carriage frame 26 and in which an ejection port is formed, on a lower face, and a sub ink tank 30 supplying the ink to each recording heads 28 which is provided detachably to the recording head carriage frame 26. The recording head 28 can be produced by, for example, micro-fabricating a silicon wafer. Also, resolution of the recording head 28 can-be set according to image quality, an image recording speed or the like which is required for the ink jet recording apparatus 12, for example, the resolution can be set to about 600 dpi.

The number of the sub ink tanks 30 corresponds to the number of the recording head 28, there are four sub ink tanks in the embodiment. Accordingly, the full color image can be recorded by supplying the different color ink (for example, black ink (Bk), yellow ink (Y), magenta ink (M), and cyan ink (C)) from each sub ink tank 30 to the corresponding recording head 28, to eject the ink droplet. The recording head 28 and its corresponding sub ink tank 30 are formed integrally into a cartridge to be a recording head unit 32, the recording head unit 32 is exchanged as a whole when, for example, the product life has been expired. Hereinafter, when the recording head 28, the sub ink tank 30, an ink replenishing unit 48 mentioned below, and the like are to be particularly distinguished according to each color, these numerals are indicated by adding Bk, Y, M, or C after the numerals.

As shown in FIG. 1, in the ink jet recording apparatus 12 of the invention, the recording medium P is carried by the recording medium carrying members 16, and while the recording head carriage 14 is traveled reciprocally, the ink droplet is ejected according to the image information to record the image on the recording medium P.

As shown in FIG. 4, in the sub ink tank 30, a partition 174 in which an ink communicating pore 176 is formed in the lower portion thereof is provided so that the sub ink tank 30 is divided into a first ink chamber 178 and a second ink chamber 180. A capillary member 182 is accommodated in the first ink chamber 178, the ink is held in the capillary member 182. In contrast, the ink is accommodated with a free state in the second ink chamber 180. The ink in the second ink chamber 180 is supplied to the recording head 28 (manifold) through an ink communicating portion at a bottom face. A filter is placed in the ink communicating portion (i.e., an upper face portion of the recording head 28), so as to prevent invasion of foreign matter from the second ink chamber 180 to the recording head 28.

AS shown in FIG. 3, a port for exhausting 34 having an exhaust opening 42 which can exhaust the air in the sub ink tank 30 and a port for replenishing ink 36 being placed below the port for exhausting 34 and having an ink replenishing opening 44 through which the ink can be replenished into the sub ink tank 30 are provided in each of the sub ink tanks 30. In the sub ink tank 30, an atmosphere communicating opening 38 through which the air is flown between an inside and an outside of the first ink chamber 178 is formed above the port for exhausting 34. The sub ink tank 30 is also provided with an ink quantity sensor 40 which detects ink quantity of an inside of the second ink chamber 180. The ink quantity sensor 40 sends the detected information of the ink quantity in the second ink chamber 180 to a control circuit which is not shown. A specific configuration of the ink quantity sensor 40 is not particularly limited, but, in the present embodiment, there is adopted a structure which includes a light emitting diode, a phototransistor (neither the light emitting diode nor the phototransistor are shown), and a prism 40P. In the ink quantity sensor 40, a reflection surface of the prism 40P is designed to constitute a total reflection surface to incident light. The liquid level is detected on the basis of the result of whether the light from the light emitting diode and incident on the prism 40P impinges on the phototransistor through the prism 40P. That is, when the ink exists on the reflection surface of the prism 40P inside the second ink chamber 180, the incident light transmits the sub ink tank and is not reflected. In contrast, when the ink level falls lower than the reflection surface of the prism 40P, the light is reflected by the reflection surface to impinge on the phototransistor, so that a small quantity of ink can be detected. In the ink quantity sensor 40 of the present embodiment, only the prism 40P is provided in the sub ink tank 30, and other components except the prism 40P (a main body of the sensor such as the light emitting diode and the phototransistor) are placed in the main body of the ink jet recording apparatus 12. Accordingly, when the ink quantity is detected, the recording head carriage 14 is moved by a predetermined distance so that the prism 40P faces to the front of the main body of the sensor. Since, by adopting the configuration described above, it is not necessary to mount the main body of the sensor on the sub ink tank 30, the weight of the sub ink tank 30 can be significantly reduced. It is also possible to integrally form the prism 40P with the same material as the sub ink tank 30. The number of parts can also be decreased by commonly forming the main body of the sensor with the prism 40P of each sub ink tank 30. In this case, it is recommended that the desired prism 40P faces to the front of the main body of the sensor by adjusting movement of the recording head carriage 14.

In the recording head unit 32, in a state before being used in service, the ink is filled in the first ink chamber 178, the second ink chamber 180 and the recording head 28, and a constant negative pressure is maintained in the sub ink tank 30. When the ink is consumed by the image recording, the ink is supplied from the first ink chamber 178 to the second ink chamber 180 through the ink communicating pore 176 while the air is supplied from the atmosphere communicating opening 38 to the first ink chamber 178. Then, when the ink which has been impregnated into the capillary member 182 in the first ink chamber 178 is almost spent and the air has reached the ink communicating pore 176, the air is supplied from the first ink chamber 178 to the second ink chamber 180 through the ink communicating pore 176. Since the air is introduced in the shape of a bubble from the ink communicating pore 176 into the second ink chamber 180, the pressure (negative pressure) in the second ink chamber 180 is controlled within a constant range by the bubble generating pressure at this time.

In this way described above, the ink level is gradually fallen by introducing the air in the second ink chamber 180 according to the ink consumption. It is detected by the ink quantity sensor 40 that a position of the ink level falls, that is, the ink quantity in the sub ink tank 30 becomes a small amount.

The type of a material constituting the sub ink tank 30 is not limited as long as the material has ink resistance to ink and satisfies predetermined conditions of moisture permeability and gas permeability. For example, when PPO (polyphenylene oxide) is used for the sub ink tank 30, the moisture permeability and the gas permeability can be sufficiently suppressed. Regarding the material of the capillary member 182 in the first ink chamber 178, a material which can hold the ink by the capillary attraction and has the resistance to ink can be used. For example, polyurethane foam is preferable to the capillary member because the polyurethane foam can adjust the capillary attraction by a change in density and has the good resistance to ink. And other materials such as porous polymer foam (so-called melanin) and felt made of polyester resin, polypropylene, acryl or the like may be used, as long as the material can properly generate the capillary attraction between the ink and has the resistance to ink.

As shown in FIG. 1, an ink replenishing device 46 comprising a plurality of ink replenishing units 48 (there are four ink replenishing units in the present embodiment) for replenishing the ink to the corresponding sub ink tanks 30 are mounted in the main body of the housing 24, a position where the ink can be replenished to the sub ink tank 30 by the ink replenishing unit 48 is set to an ink replenishing position of the recording head carriage 14. In the same as the home position, the ink replenishing position is also detected by the position sensor 22. The ink replenishing position may be the same position as the home position, however, in the embodiment, the ink replenishing position differs from the home position in position.

As shown in FIG. 2 and FIG. 3, a main ink tank 50 is arranged below the ink replenishing device 46. In the main ink tank 50, the ink which is used by the ink jet recording apparatus 12 is stored beforehand, and the ink is replenished to the sub ink tank 30 by the ink replenishing device 46 to be used for the image recording. The main ink tank 50 is arranged to at least partially overlap with the ink replenishing device 46 in a plan view (substantially, across the whole in the present embodiment), so that the size of the ink jet recording apparatus 12 is reduced as a whole.

An atmosphere communicating opening, which is not shown in the drawings, is formed in the main ink tank 50. The atmosphere communicating opening is closed by a valve, which is not shown, either, in a state in the main ink tank 50 has not yet been attached to the ink jet recording apparatus 12. Consequently, an airtight structure is maintained in the main ink tank 50 and ink is not carelessly leaked out.

When the main ink tank 50 is attached to the ink jet recording apparatus 12, the valve is pressed by a projection of the ink jet recording apparatus to be separated from a gasket of the atmosphere communicating opening, and the main ink tank 50 is communicated with the atmosphere. This allows the ink in the main ink tank 50 to be stored in the free state.

Similarly to the case of the sub ink tank 30, whatever a material having the resistance to ink and satisfying given conditions in terms of the moisture permeability and the gas permeability may be used as the material configuring the main ink tank 50 (particularly a portion which is brought into contact with the ink such as a box-shaped portion). For example, the main ink tank 50 can be made of polypropylene resin. Like the sub ink tank 30, the PPO (polyphenylene oxide) may be used for the main ink tank 50.

Figure 5:
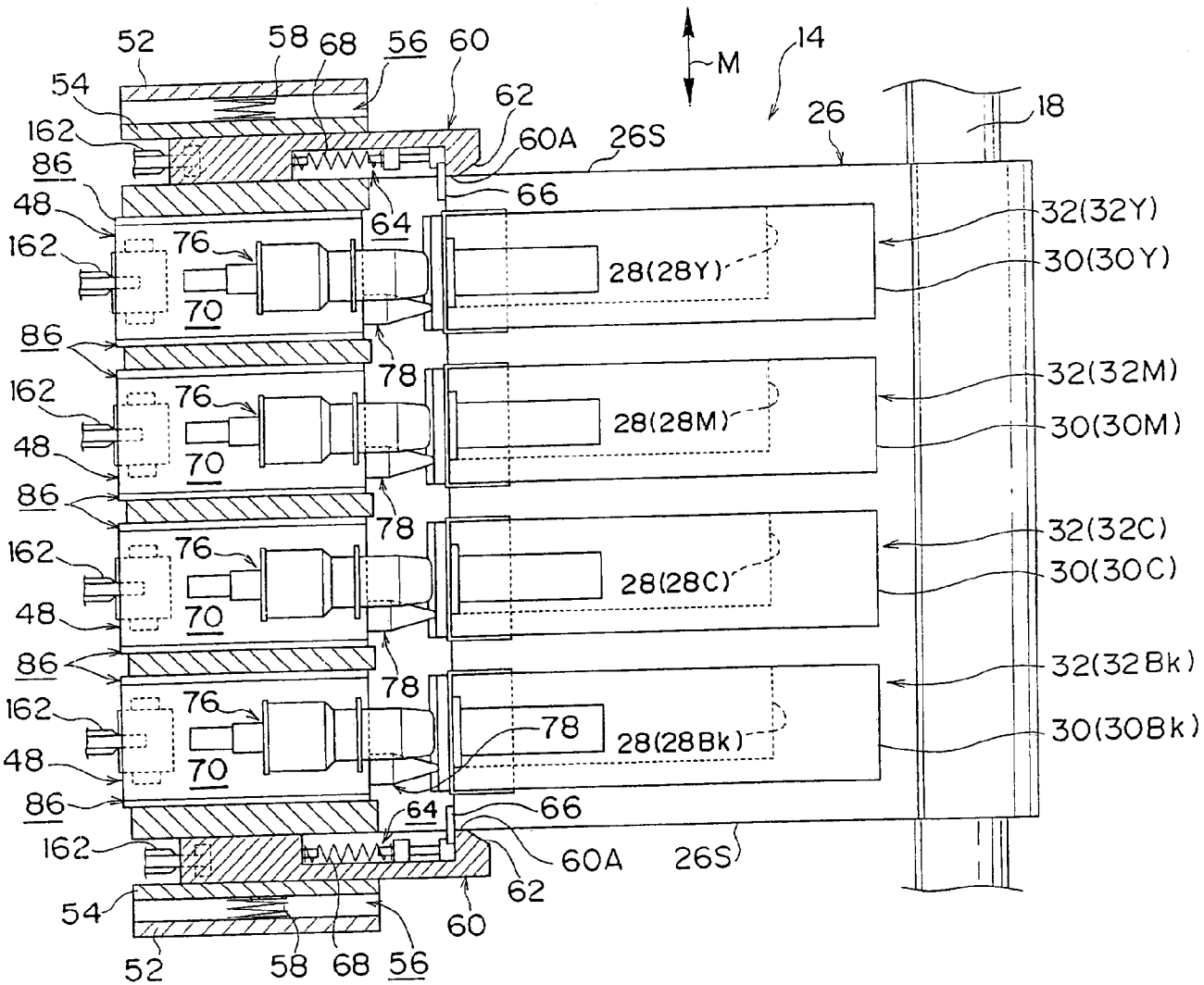
FIG. 5 is a partially ruptured plan view showing in enlarged dimension an ink replenishing unit of an ink replenishing device and a sub ink tank of an ink jet recording apparatus according to an embodiment of the invention.

As shown in detail in FIG. 4 and FIG. 5, the ink replenishing device 46 has a stationary frame 52 which is integrally fixed to the main body of the housing 24 of the ink jet recording apparatus 12, and a guide frame body 54 is arranged in the stationary frame 52. A given gap 56 is formed between the stationary frame 52 and the guide frame body 54 in the widthwise direction. In the stationary frame 52, the guide frame body 54 is movable within a given range in the same direction as the moving direction (main scanning direction) of the recording head carriage 14. A helical compression spring 58 is placed in the gap 56, such that the guide frame body 54 is held at about center in a widthwise direction in the stationary frame 52. Hereinafter, the term "the widthwise direction" will represent the same direction as the widthwise direction of the guide frame body 54. The "widthwise direction" corresponds to the main scanning direction (in the direction of the arrow M) of the recording head carriage 14.

In the vicinity of both ends in the widthwise direction of the guide frame body 54, a pair of positioning arms 60 are provided such that the positioning arms 60 are slidable toward the recording head carriage 14. As shown in FIGS. 2 and 3, the positioning arms 60 are located so as not to contact the recording head carriage 14 in a normal state. A distance between both inside faces 60A (opposite surfaces) of the positioning arms 60 is set to be equal to a width of a recording head carriage frame 26 of the recording head carriage 14.

As shown in FIGS. 2 and 5, in the positioning arm 60, a tapered face 62 which is cut obliquely relative to the recording head carriage 14 is formed at an end portion of a recording head carriage 14 side. As shown by a solid line in FIG. 2, in the case that the recording head carriage 14 is shifted to the guide frame body 54 in the widthwise direction while the recording head carriage 14 is stopped at the ink replenishing position (the recording head carriage frame 26 at a normal position is shown by a dash-double dot line in FIG. 2), either of the tapered faces 62 of the positioning arms 60 contacts a corner portion of the recording head carriage frame 26 when the positioning arms 60 approaches the recording head carriage 14. As a result, the movement of the positioning arms 60 in this approaching direction is converted into the movement in the widthwise direction of the guide frame body 54, when the positioning arm 60 further approaches to the recording head carriage 14. This allows the guide frame body 54 to move in the widthwise direction against elastic force of the helical compression spring 58 (one of the gaps 56 between the stationary frame 52 and the guide frame body 54 are extended and the other is narrowed). When the positioning arm 60 further approaches the recording head carriage 14, as shown in FIG. 5, a side face 26S of the recording head carriage frame 26 is made into contact with an inside face 60A of the positioning arm 60, and the recording head carriage 14 and the guide frame body 54 are correctly positioned in the widthwise direction. Consequently, four ink replenishing units 48 are integrally positioned to the corresponding sub ink tanks 30.

Figure 6:
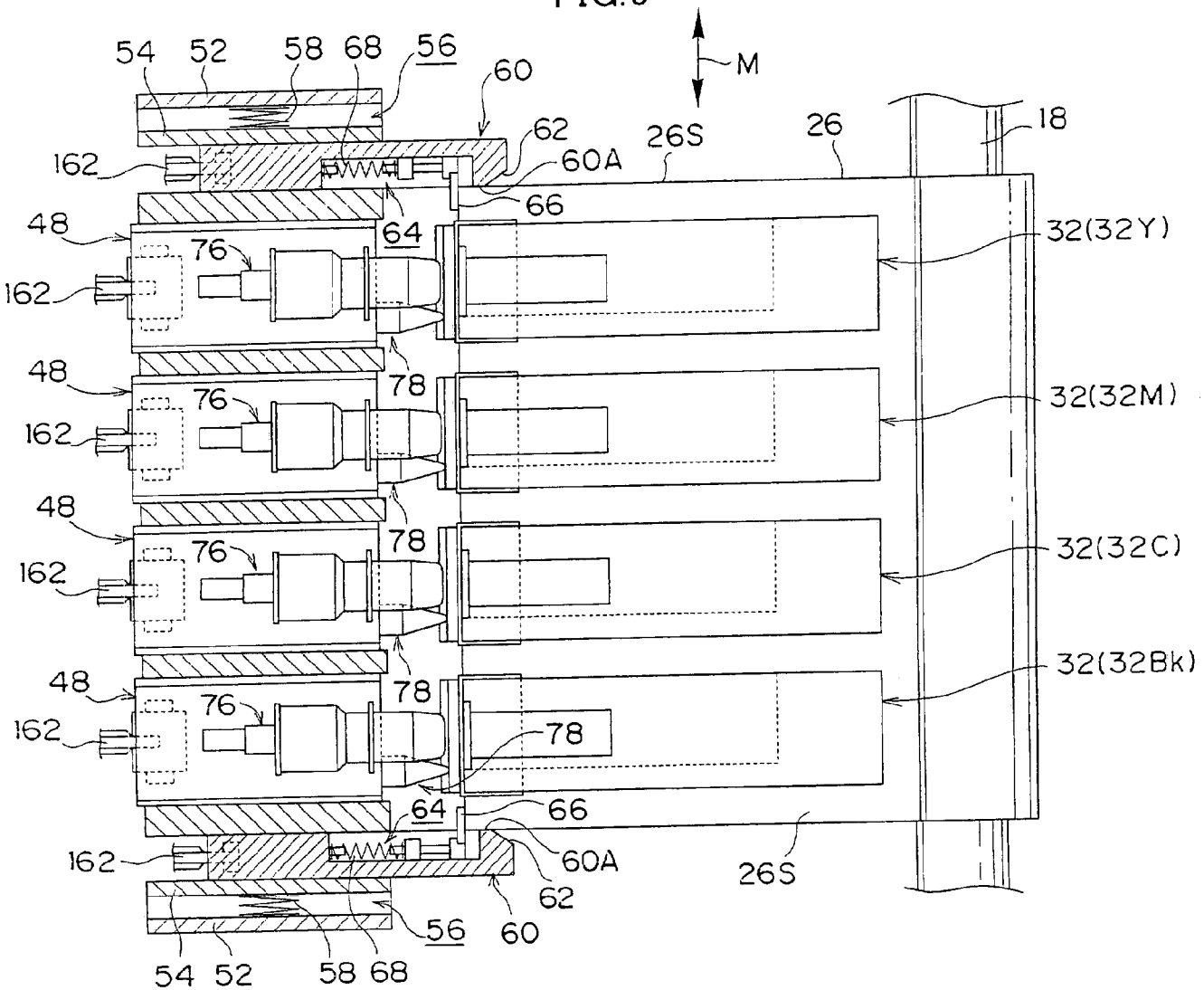
FIG. 6 is a partially ruptured plan view showing in enlarged dimension an ink replenishing unit of an ink replenishing device and a sub ink tank of an ink jet recording apparatus according to an embodiment of the invention with a positioning arm advanced.

As shown in FIGS. 5 and 6, the inside of the positioning arm 60 is adapted to function as a pressing piece accommodating portion 64, and a portion of a pressing piece 66 accommodated in the pressing piece accommodating portion 64 projects from the inside face 60A of the positioning arm 60. The pressing piece 66 is slidable inside the pressing piece accommodating portion 64, and the pressing piece 66 is urged toward a direction of approaching the recording head carriage 14 by the helical compression spring 68. In a state in which the side face 26S of the recording head carriage frame 26 has been brought into contact with the inside face 60A of the positioning arm 60 and the recording head carriage 14 and the guide frame body 54 have been correctly positioned in the widthwise direction, when the positioning arm 60 further advances toward the recording head carriage 14, as shown in FIG. 6, the pressing piece 66 which receives biased force of the helical compression spring 68 presses the recording head carriage 14. Consequently, the recording head carriage 14 is held tight between the pressing piece 66 and the guide member 18, and play of the recording head carriage 14 is prevented.

In the guide frame body 54, the ink replenishing units 48 are provided corresponding to the four sub ink tanks 30. Each of the ink replenishing units 48 is independently slidable within an accommodating portion 70 provided in the guide frame body 54, so that the ink replenishing units 48 approach and separate from the corresponding sub ink tank 30, respectively. As can be seen from FIG. 1, a travelling area within which the ink replenishing units 48 approach or separate from the recording head carriage 14 (corresponding sub ink tank 30) is arranged so as not to overlap with the moving area withiin which the maintenance station 20 approaches or separates from the recording head carriage 14. Accordingly, when either the ink replenishing unit 48 or the maintenance station 20 approaches or separates from the recording head carriage 14, the other is not required to take shelter.

As shown in FIGS. 3 and 4, on a face of each of the ink replenishing units 48, which is opposite to the sub ink tank 30, a port for exhausting 74 is provided at a position corresponding to the exhaust opening 42 of the sub ink tank 30 and a port for replenishing ink 76 is provided at a position corresponding to the ink replenishing opening 44 of the sub ink tank 30, respectively. The port for exhausting 74 is connected to the exhaust opening 42 and the port for replenishing ink 76 is connected to the ink replenishing opening 44, respectively, as a result of the ink replenishing units 48 moving toward the sub ink tank 30.

Each of the ink replenishing units 48 is provided with a cap 72 at a position corresponding to the atmosphere communicating opening 38 of the sub ink tank 30. The shape, mounted position, and the like of the cap 72 are set in a manner that, when the ink replenishing unit 48 has approached the sub ink tank 30, the port for exhausting 74 is connected to the exhaust opening 42, the port for replenishing ink 76 is connected to the ink replenishing opening 44 and thereafter the ink replenishing unit 48 further approaches the sub ink tank 30 thereafter, the atmosphere communicating opening 38 is then sealed by the cap 72 to obstruct the communication of the air between the inside and the outside of the sub ink tank 30.

A positioning pin 78 is provided to be projected from the ink replenishing unit 48 toward the sub ink tank 30. On the other hand, in the sub ink tank 30, a positioning port 80 is provided at a position corresponding to the positioning pin 78. The positioning pin 78 includes a columnar positioning portion 82 having a predetermined outer diameter and a guide portion 84 which is formed in the shape of a cone and provided at the tip end side of the positioning portion 82. The outer diameter of the positioning portion 82 is substantially equal to an inner diameter of the positioning port 80. When the ink replenishing unit 48 approaches the sub ink tank unit 30, the guide portion 84 of the positioning pin 78 on the tip end side enters the positioning port 80. Since the guide portion 84 is formed to be the taper shape, even if a center of the positioning pin 78 is shifted relative to the center of the positioning port 80, the positioning pin 78 enters the positioning port 80. As the ink replenishing unit 48 further approaches the sub ink tank 30, the positioning pin 78 and the positioning port 80 are gradually moved by the guide portion 84 to a direction in which the center of the positioning pin 78 and the center of the positioning port 80 coincide with each other. Furthermore, when the positioning portion 82 reaches the positioning port 80, the center of the positioning pin 78 coincides with the center of the positioning port 80, whereby the ink replenishing units 48 and the sub ink tank 30 are correctly positioned, respectively.

As shown in FIGS. 3 to 5, a gap 86 of a predetermined width is formed between an upper face, a bottom face, and both side faces of the ink replenishing unit 48 and the upper face, the bottom face, and both the side faces in the accommodating portion 70 for accommodating the ink replenishing units 48. A guide pin 88 projects from each of the aforementioned faces of the ink replenishing units 48. Each guide pin 88 is accommodated in a guide groove 90 which is formed at each face of the accommodating portion 70.

As can be seen from FIG. 4, a holding portion 90A which is slightly wider than the outer diameter of the guide pin 88 and a width-wide portion 90B whose width is gradually increased in the vicinity of each end portion near the sub ink tank 30 are formed in the guide groove 90. The position of the width-wide portion 90B is set such that the guide pin 88 exists in the width-wide portion 90B in a state in which the ink replenishing units 48 have approached the sub ink tank 30 and the positioning pin 78 has entered the positioning port 80. Accordingly, in a state in which the positioning pin 78 has not entered the positioning port 80, the guide pin 88 travels in the holding portion 90A and the ink replenishing units 48 slides without play in the accommodating portion 70. Then, in a state in which the positioning pin 78 has entered the positioning port 80, as the guide pin 88 has reached the width-wide portion 90B and the gap is formed between the guide pin 88 and the width-wide portion 90B, the ink replenishing units 48 can move within a predetermined range in up and down directions and the widthwise direction in the accommodating portion 70. Accordingly, in this state, that is, in the state in which the positioning pin 78 has entered the positioning port 80, guidance of the ink replenishing units 48 by the guide pin 88 and guide groove 90 is substantially released, and then the correct positioning is carried out by the positioning pin 78 and the positioning port 80. Furthermore, since the gap between the guide pin 88 and the width-wide portion 90B is increased as the guide pin 88 closely approaches the sub ink tank 30, the range where the ink replenishing units 48 can move in the up and down directions and the widthwise direction is also increased in accordance with the increase in the gap.

Figure 9:
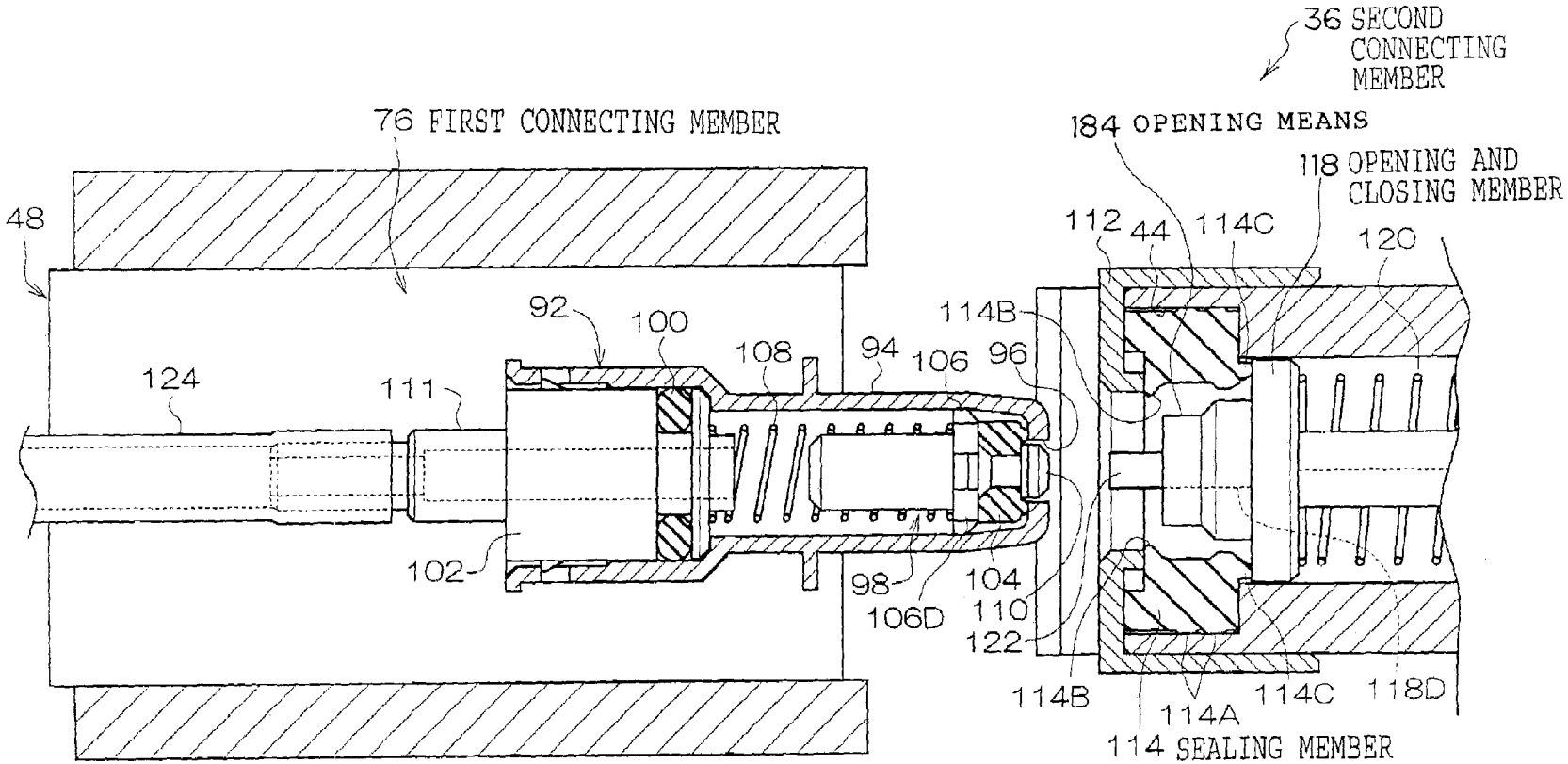
FIG. 9 is a sectional view showing a connecting part structure of a port for replenishing ink of an ink replenishing device and an ink replenishing port of an sub ink tank according to an embodiment of the invention.

In the port for replenishing ink 76 which is provided in each ink replenishing unit 48, as shown in FIG. 9, a pipe for replenishing ink 92 is provided. The pipe for replenishing ink 92 includes a main body of the pipe 94, which main body is formed in substantially cylindrical shape as a whole. A communicating hole 96 for discharging the ink which is to be replenished to the sub ink tank 30 is formed in a tip end of the main body of the pipe 94. The vicinity of the tip end portion of the main body of the pipe 94 is formed in the taper shape whose diameter is decreased in a direction of the tip end.

In the main body of the pipe 94, valve body 98 is accommodated movably in the longitudinal direction thereof, and a bracket 102 is press-fitted into a back end side of the main body of the pipe 94 by way of an O-ring 100.

Figure 10A:
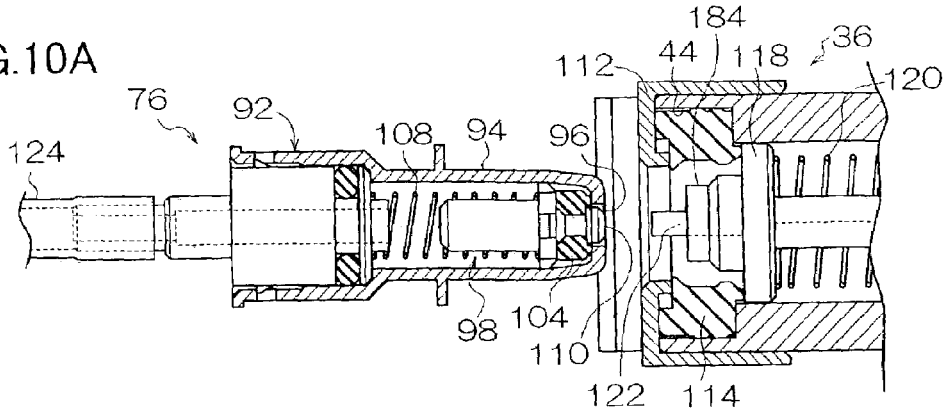
FIGS. 10A to 10D are sectional views showing in order a process which a port for replenishing ink of an ink replenishing device and an ink replenishing port of an sub ink tank according to an embodiment of the invention are connected.
Figure 10B:
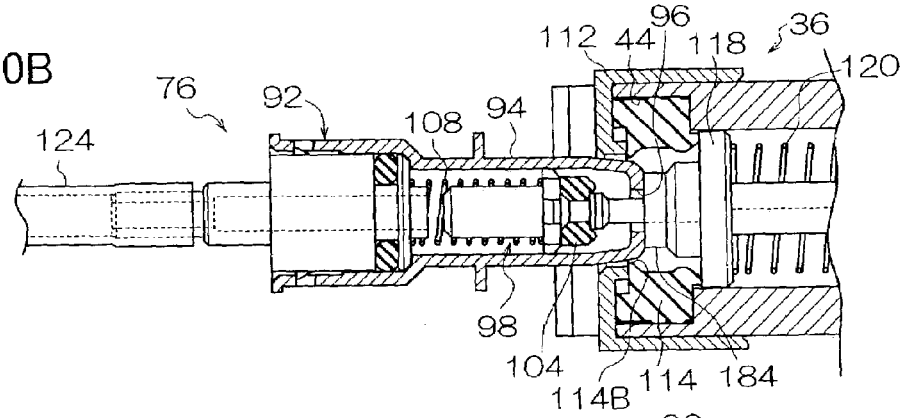
Figure 10C:
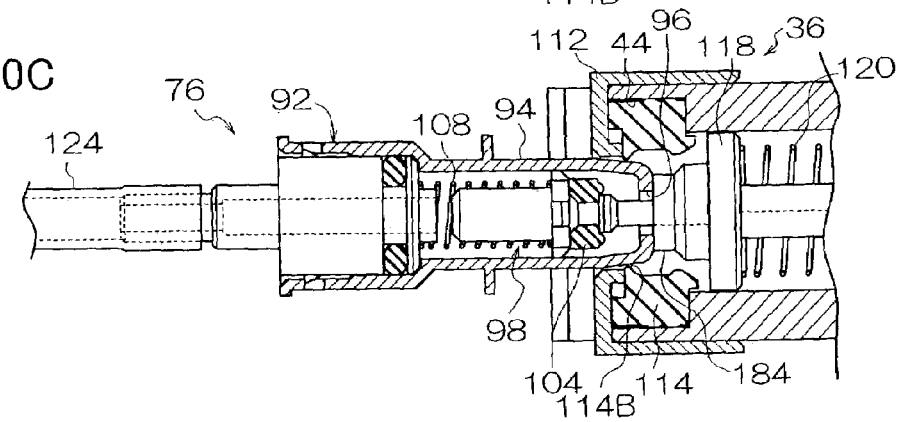
Figure 10D:
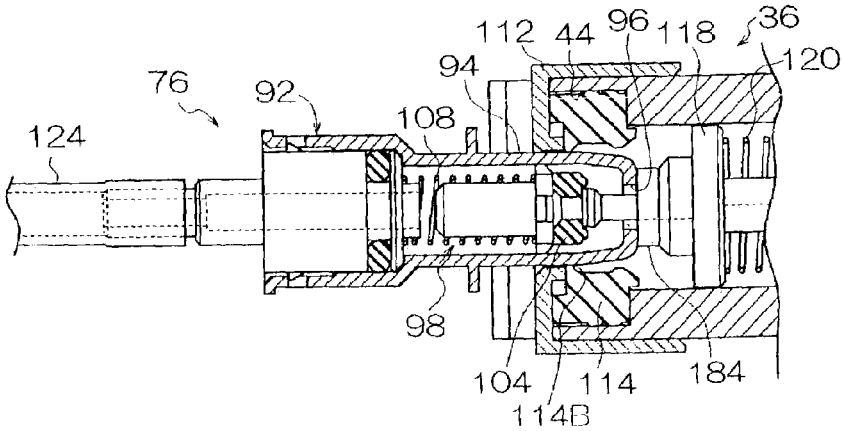

The valve body 98 comprises a ring packing 104 formed by an elastic member, a packing holder 106 which holds the packing 104 and is slidable in the main body of the pipe 94, and a helical compression spring 108 which is provided between the packing holder 106 and the bracket 102 and biases the packing holder 106 and the packing 104 in a direction toward the communication port 96. Normally, the packing holder 106 and the packing 104 are urged by the helical compression spring 108 in the direction toward the communicating hole 96 and the packing 104 is press-attached to a periphery of the communicating hole 96, whereby the communicating hole 96 is closed. However, as shown in FIGS. 10C and 10D, when the packing holder 106 and the packing 104 slide against the urging force of the helical compression spring 108 to separate from the periphery of the communicating hole 96, the ink can be flown.

A valve abutting portion 110 is formed to be projected from the packing holder 106. The valve abutting portion 110 penetrates the packing 104 and the tip end thereof is exposed from the communicating hole 96, so that the tip end of the valve abutting portion 110 is pressed by a valve projection portion 122 described later.

In the rear end of the bracket 102, one end of a tube for replenishing ink 124 is connected by way of a cover 112. As shown in FIG. 3, the other end of the tube for replenishing ink 124 is connected to the main ink tank 50 in which the ink to be used for the image recording is stored beforehand. Accordingly, the port for replenishing ink 76 (pipe for replenishing ink 92) is provided in the main ink tank 50 by way of the tube for replenishing ink 124. AS described later, when the port for replenishing ink 76 is connected to the ink replenishing opening 44 of the sub ink tank 30, an ink channel from the main ink tank 50 to the sub ink tank 30 is formed. The other end of the tube for replenishing ink 124 is connected to a lower portion of the main ink tank 50, so that the ink in the main ink tank 50 can be used up without leaving any left-over ink therein.

A gasket 114 is placed inside the ink replenishing opening 44 of the sub ink tank 30 and held at a predetermined position by a gasket cover 112 so as not to be dropped out. A bulge 114A which is bulged out in the shape of the ring is formed in an outer periphery of the gasket 114. The bulge 114A is press-attached to the inside face of the ink replenishing opening 44, whereby flow of the ink or the air from the ink replenishing opening 44 is obstructed. Further, a lip portion 114B which is projected in the shape of the ring in the radially-inner direction is also formed in the gasket 114. As shown in FIGS. 10C and 10D, the lip portion 114B contacts the inserted main body of the pipe 94, from the outside and along the full perimeter thereof, to obstruct at the gasket 114 the flow of the ink or the air through the outer surface of the pipe 94.

A pressure ring 116 is provided to be projected from the gasket cover 112 toward the gasket 114, so that, when the main body of the pipe 94 is inserted and extracted, deformation of the lip portion 114B in the inserting and extracting direction is limited within a given range by the pressure ring 116. Due to this, the lip portion 114B is prevented from moving undesirably to become an obstacle against insertion and extraction or decreasing in the sealing property thereof to the outer periphery of the main body of the pipe 94, when the main body of the pipe 94 is moved (insertion and extraction) in the ink replenishing opening 44.

In the ink replenishing opening 44, a valve 118 is placed further remote side than the gasket 114. The valve 118 is normally urged by a helical compression spring 120 in the ink replenishing opening 44 and pressed to a ring-shaped projection portion 114C, which is formed in the gasket 114, to close the ink channel. However, as shown in FIGS. 10C and 10D, when the valve 118 slides against the biasing force of the helical compression spring 120 to separate from the projection portion 114C, the ink channel is formed. In the present embodiment, a spring constant of the helical compression spring 120 is set larger than that of the helical compression spring 108.

A valve projection portion 122 is formed in a manner that the valve projection portion 122 projects from the valve 118 by way of a to-be-to-be-pressed piece 184 50 as to be opposite to the valve abutting portion 110 of the packing holder 106. The pressed portion according to the invention is constituted of the to-be-pressed piece 184 and the valve projection portion 122. When the main body of the pipe 94 is inserted into the ink replenishing opening 44, as shown in FIG. 10B, before the outer periphery of the main body of the pipe 94 contacts the lip portion 114B, the tip end or nose of the valve abutting portion 110 contacts the nose of the valve projection portion 122 and the main body of the pipe 94 and the valve projection portion 122 press each other. This pressing force allows the valve body 98 and the valve 118 to be slid, which results in the formation of the ink channel. In the present embodiment, the spring constant of the helical compression spring 120 is set larger than that of the helical compression spring 108. As shown in FIG. 10B, at first the ink passage is formed in the main body of the pipe 94, and then, as shown in FIG. 10C, the ink channel is formed in the ink replenishing opening 44.

Figure 17:
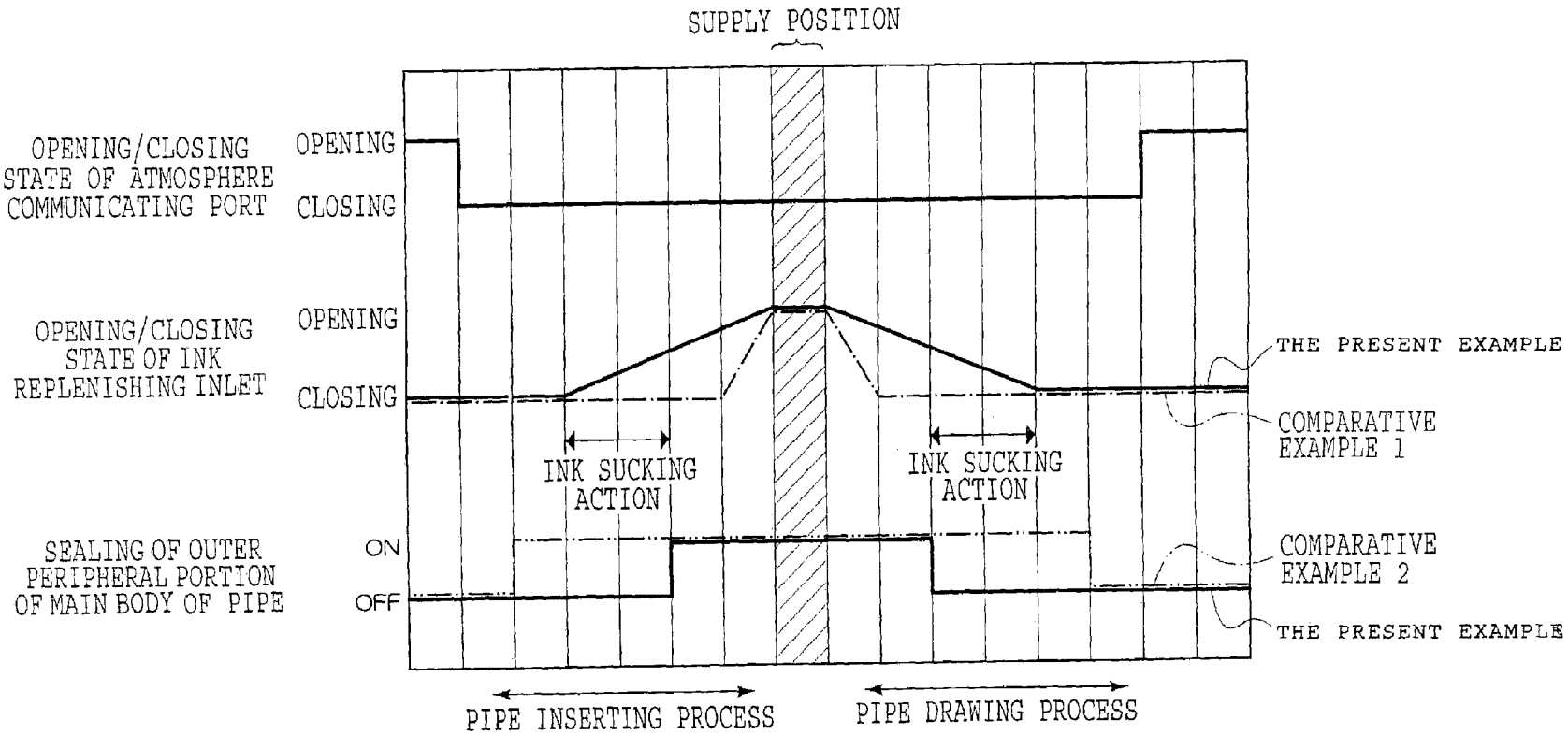
FIG. 17 is a timing chart showing a connecting condition of a port for replenishing ink of an ink replenishing device and an ink replenishing port of a sub ink tank according to an embodiment of the invention.

FIG. 17 shows open/closed states of the atmosphere communicating opening 38 and the ink replenishing opening 44, and timing of a sealing state of the outer peripheral portion of the main body of the pipe 94. The case of the present embodiment is shown by the solid line in FIG. 17. In FIG. 17, the open/closed states of the ink replenishing opening in the case of comparative example 1 described later is shown by a dash line. Further, in FIG. 17, the open/closed states of the ink replenishing opening of another comparative example (comparative example 2), which does not correspond to the invention, is shown by the dash-double dot line. The comparative example 1 is an example in which the timing in starting to open the ink replenishing opening is later than that of the present embodiment (see the dash line), although the timing in the sealing of the outer periphery portion of the main body of the pipe is the same as the embodiment (see the solid line). The comparative example 2 is an example in which the timing in sealing the outer periphery portion of the main body of the pipe is earlier (see the dash-double dot line), although the timing in starting to open the ink replenishing opening is the same as the embodiment (see the solid line). In both of the comparative examples 1 and 2, the ink channel is formed after the outer peripheral portion of the main body of the pipe is sealed. In contrast, in the preset embodiment, at an initial stage of opening ink replenishing opening 44, the outer periphery of the main body of the pipe 94 does not contact the lip portion 114B, and the ink channel is arranged to be opened into the atmosphere. Accordingly, when the air is sucked through the gap between the outer peripheral portion of the main body of the pipe 94 and the lip portion 114B due to the negative pressure in the sub ink tank 30, the ink which remains in and adheres to the outer peripheral portion of the main body of the pipe 94 or the inside of the ink replenishing opening 44 is also simultaneously sucked into the sub ink tank 30. Inserting operation of the main body of the pipe 94 continues after this absorption of the ink. Finally, as shown in FIG. 10D, the outer peripheral portion of the main body of the pipe 94 is brought into close contact with the lip portion 114B, and the ink replenishing unit 48 and the sub ink tank 30 are liquid-connected. At the same time, as can also be seen from FIG. 17, sucking operation of ink at the outer peripheral portion of the main body of the pipe 94 and at the inside of the ink replenishing opening 44 is also finished. In both the packing holder 106 and the valve 118, communicating pores 106D and 118D are formed so that the flow of the ink is not obstructed during the liquid connection.

Figure 11:
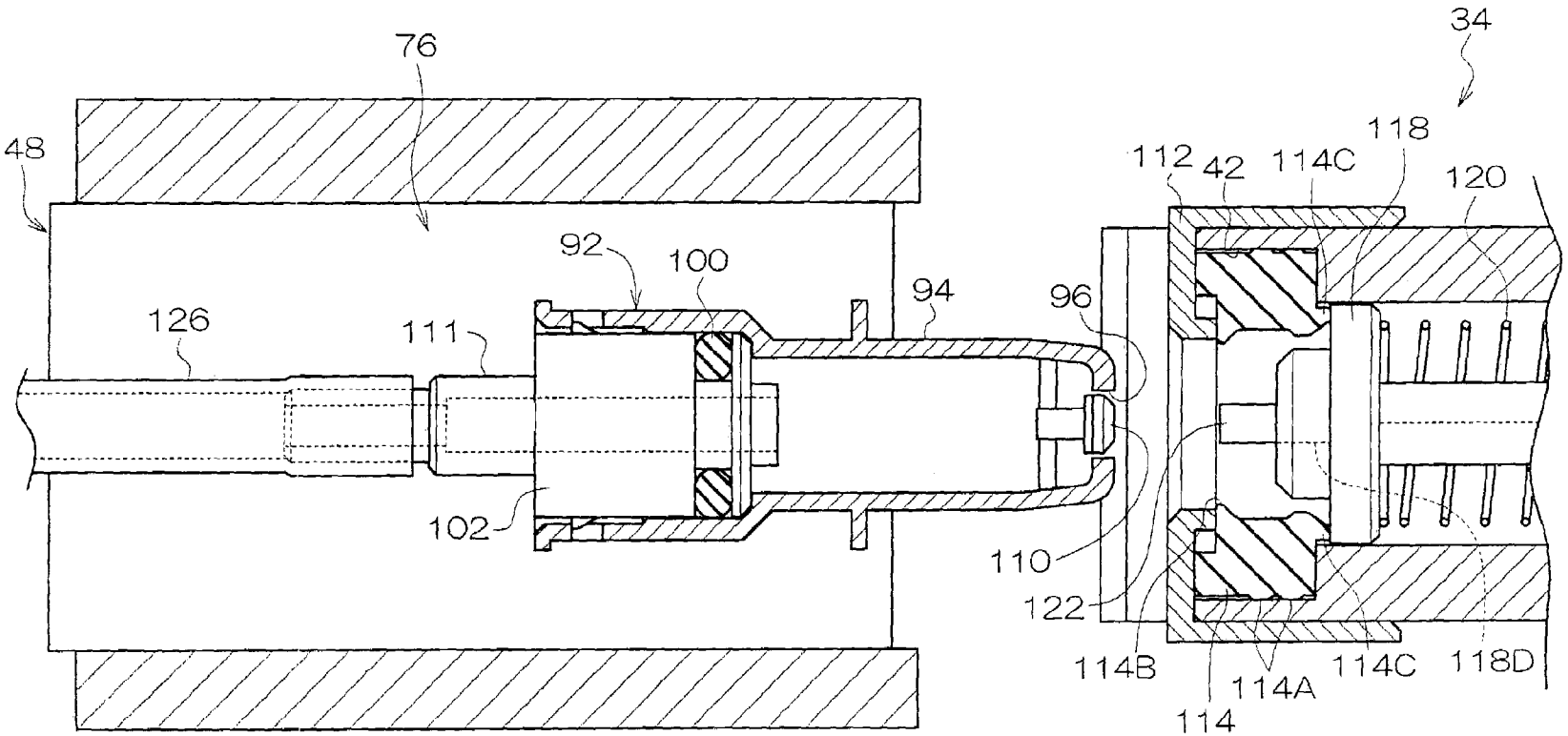
FIG. 11 is a sectional view showing a connecting part structure of a port for exhausting of an ink replenishing device and an evacuating port of an sub ink tank according to an embodiment of the invention.
Figure 18:
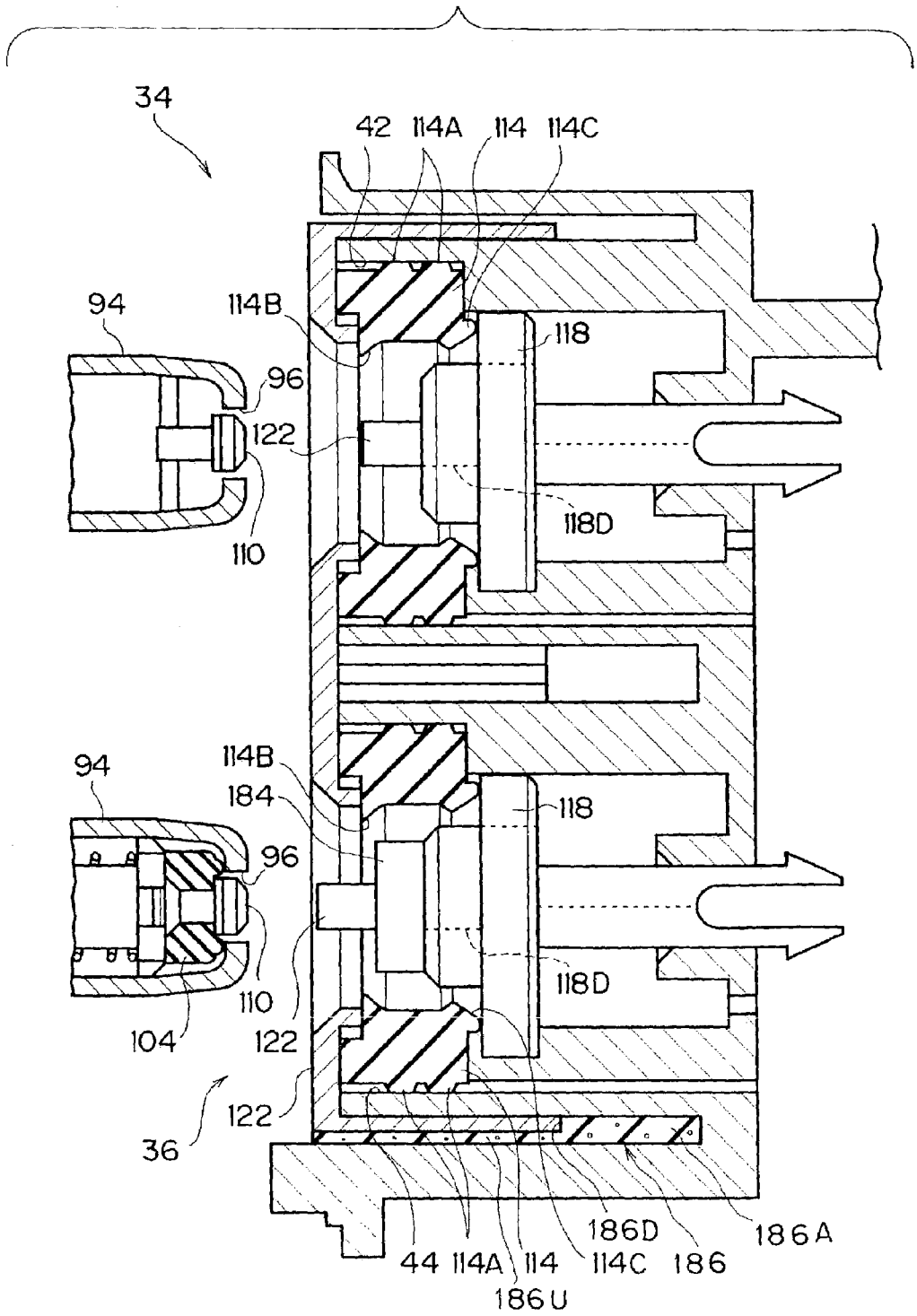
FIG. 18 is a sectional view showing aport for replenishing ink and a port for exhausting of an ink replenishing device according to an embodiment of the invention.

FIG. 18 shows the port for exhausting 74 and the exhaust opening 42. As described later, the port for exhausting 74 and the exhaust opening 42 are used for exhausting the air in the sub ink tank 30, and the ink is not flowed inside the port for exhausting 74 and the exhaust opening 42. For this reason, in the port for exhausting 74, the valve body 98 is not provided inside the main body of the pipe 94. That is, while the communicating hole 96 of the main body of the pipe 94 is always opened, the valve abutting portion 110 which can press the valve projection portion 122 is provided at a portion of the main body of the pipe 94. As can be understood when compared with the above-described valve 118 of the ink replenishing opening 44, the to-be-pressed piece 184 is not formed at the valve 118 of the exhaust opening 42 and a projection length of the valve projection portion 122 is shortened by the length of the to-be-pressed piece 184. Thus, the opening/closing timing of the exhaust opening 42 is the same as the opening/closing timing of the ink replenishing opening of the comparative example 1 shown by the dashed line in FIG. 17. Specifically, when the main body of the pipe 94 of the port for exhausting 74 is inserted into the exhaust opening 42, the outer periphery of the main body of the pipe 94 is first brought into close contact with the lip portion 114B, and then the valve abutting portion 110 presses the valve projection portion 122 to push the gasket 114, so that a passage of the air is formed and the air in the sub ink tank 30 can be exhausted from the tube for exhausting 126. Since the port for exhausting 74 and the exhaust opening 42 are of the same configurations as the port for replenishing ink 76 and the ink replenishing opening 44 shown in FIG. 9 except for the features described above, the same component, member, and the like are indicated by the same numerals and signs in FIG. 11 to abbreviate the description.

Figure 19:
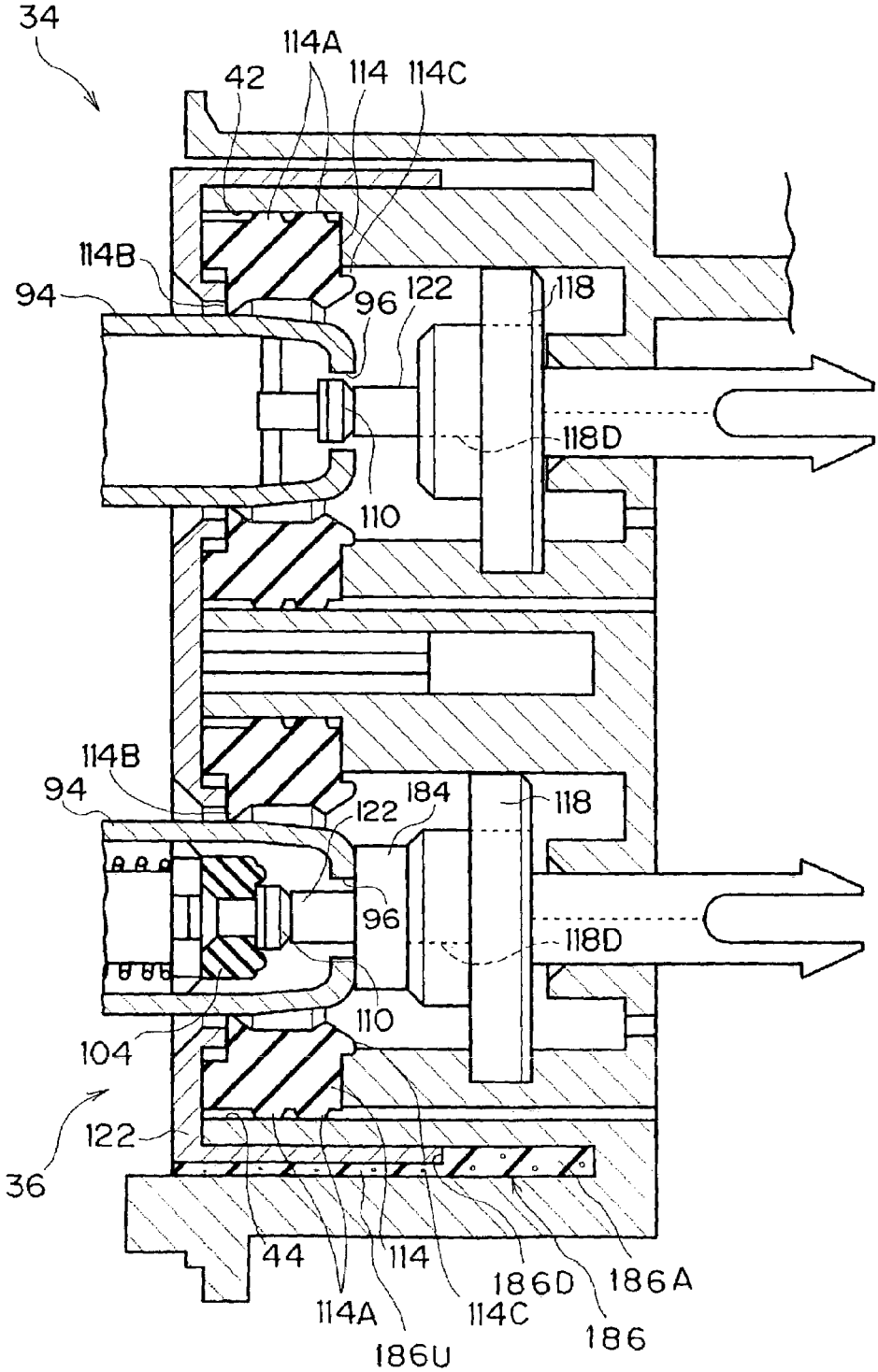
FIG. 19 is a sectional view showing aport for replenishing ink and a port for exhausting of an ink replenishing device according to an embodiment of the invention.
Figure 20:
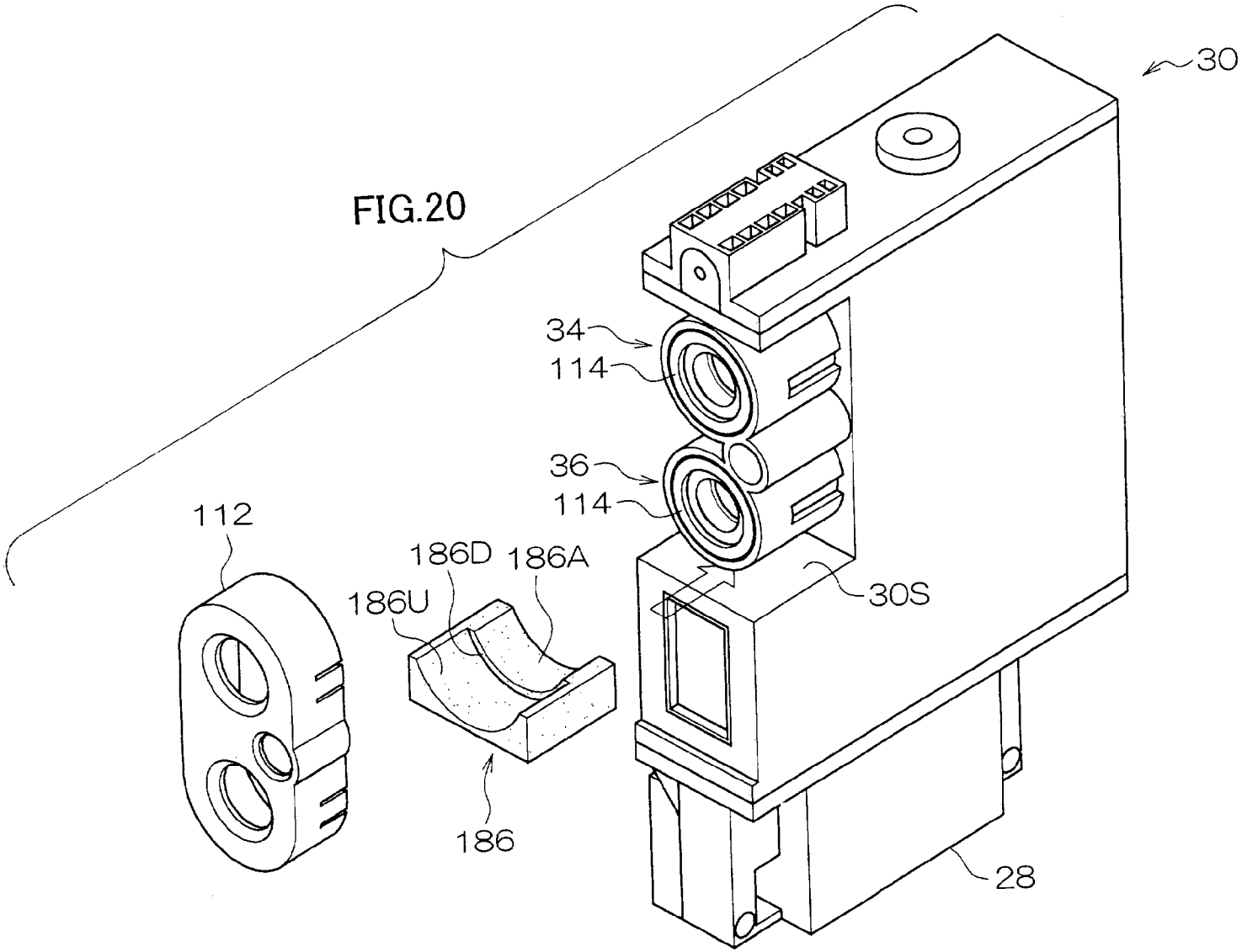
FIG. 20 is a perspective view showing a sub ink tank according to an embodiment of the invention.
Figure 21:
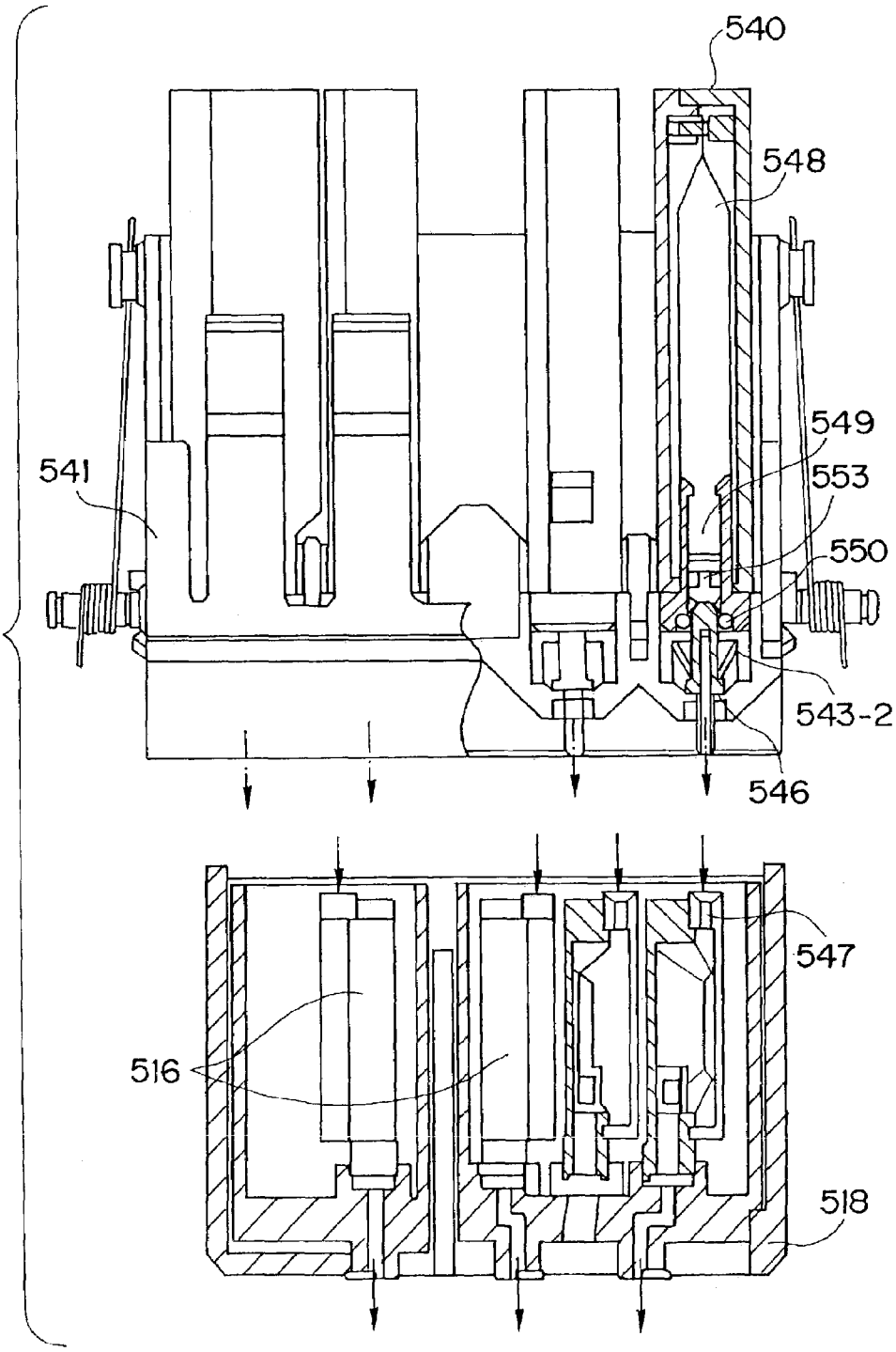
FIG. 21 is an explanatory view showing an ink replenishing device of the related art.

As shown in FIGS. 18 to 20, an ink absorber 186 including the porous material which can absorb the ink is placed below the gasket cover 112. A bottom face of the ink absorber 186 is formed in the shape of a flat surface and placed in contact with a mounting face 30S of the sub ink tank 30. A recessed portion is formed at an upper face of the ink absorber 186, such that a thick portion 186A located more remote inside than the gasket cover 112 and a thin portion 186U located more outer side of the gasket cover 112 are formed at the upper face of the ink absorber 186. A step face 186D between the thick portion 186A and the thin portion 186U contacts the gasket cover 112, which prevents the accidental positional shift or the dropout of the ink absorber 186.

Figure 12:
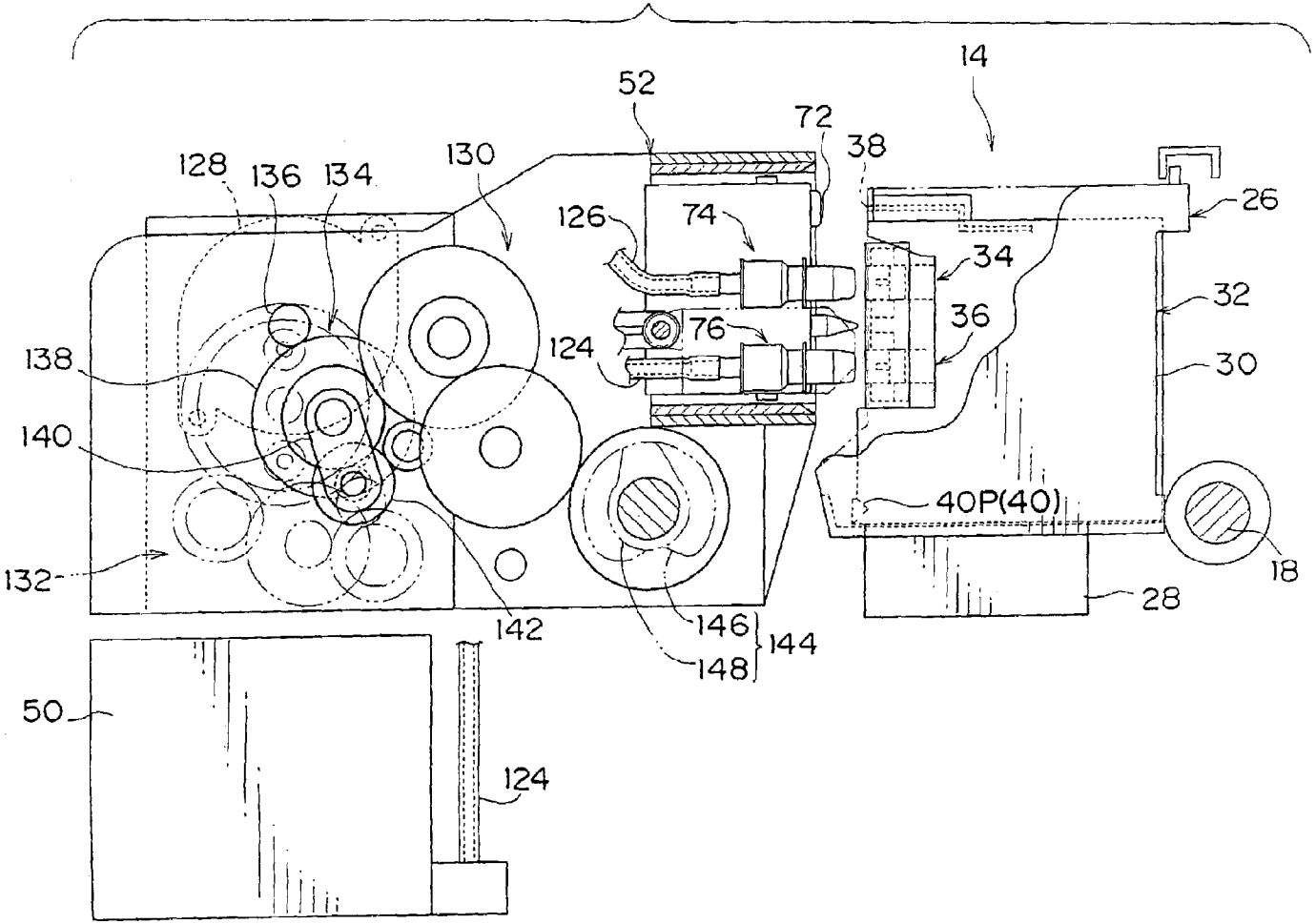
FIG. 12 is a partially ruptured side view showing a driving system for displacing an ink replenishing unit in an ink replenishing device according to an embodiment of the invention.
Figure 13:
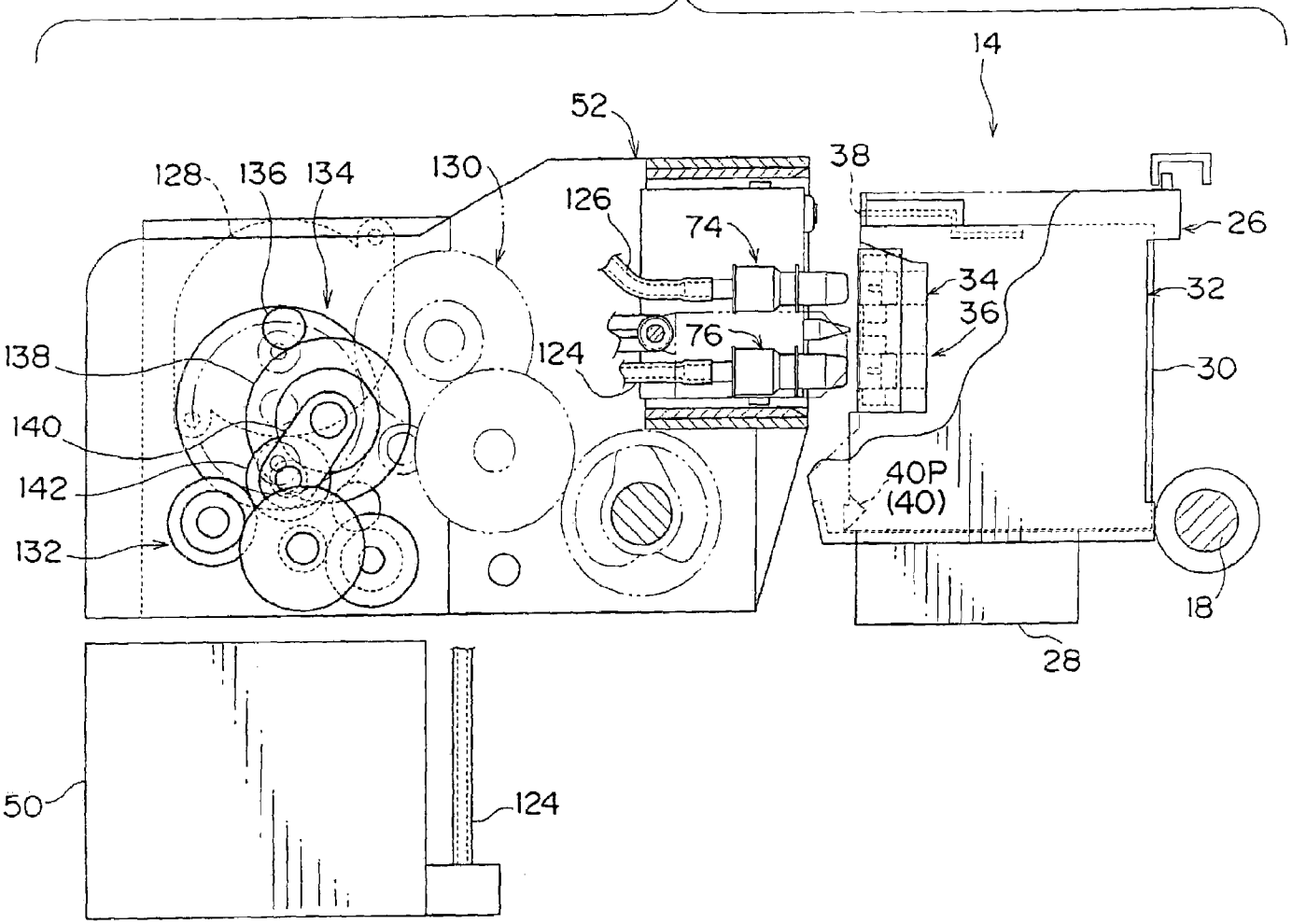
FIG. 13 is a partially ruptured side view showing a driving system for driving a pump unit in an ink replenishing device according to an embodiment of the invention.

As shown in FIGS. 2, 12, and 13, the stationary frame 52 is provided with a drive motor 128 for driving the ink replenishing device 46, a row of gears 130 for displacing the ink replenishing unit rotated by the driving force of the driving motor 128, a row of gears 132 for driving the pump, a clutch unit 134 which changes transmission of torque to the row of gears 130 for displacing the ink replenishing unit or the row of gears 132 for driving the pump according to normal/reverse rotation of the drive motor 128.

The clutch unit 134 includes an input side gear 138 which meshes with a driving gear 136 of the drive motor 128, an oscillating arm 140 which is oscillatably arranged around a shaft of the input side-gear 138, and an output side gear 142 which is mounted on a nose or tip end of the oscillating arm 140 and meshes with the input gear 138 to receive the torque. When the drive motor 128 rotates in the normal direction, as shown in FIG. 12, the oscillating arm 140 oscillates counterclockwise and the output side gear 142 meshes with the row of gears 130 for displacing the ink replenishing unit. In contrast, when the drive motor 128 reversely rotates, as shown in FIG. 13, the oscillating arm 140 is oscillated clockwise and the output side gear 142 meshes with the row of gears 132 for driving the pump.

As can be seen from FIGS. 2, 3, and 12, a cam unit 144 which is rotated by the torque transmitted by the row of gears 130 for displacing the ink replenishing unit is placed in the stationary frame 52 so as to correspond to each ink replenishing unit 48 and positioning arm 60 (there are provided totally six cam units in the present embodiment) and integrally rotate with the same shaft. Each cam unit 144 includes a forward cam 146 which advances the corresponding ink replenishing unit 48 or positioning arm 60 and a backward cam 148 for backward movement thereof.

A cam follower unit 150 is also placed in the stationary frame 52. A cam follower 152 for forward movement corresponding to the cam 146 for forward movement and a cam follower 154 for backward movement corresponding to the cam 148 for backward movement are integrally provided in the cam follower unit 150, and the cam follower unit 150 is arranged to be slidable in the same direction as the sliding direction of the ink replenishing unit 48.

Furthermore, a linkage mechanism 158 including a link 160 which is oscillatable around a supporting shaft 156 and an arm for displacing 162 whose one end is pivoted at a nose or tip end of the link 160 is provided in the stationary frame 52. The other end of the arm for displacing 162 is pivoted at the positioning arm 60 or the ink replenishing unit 48. The cam follower unit 150 is pivoted substantially at the center of the link 160. Due to the aforementioned structure, when the cam follower unit 150 is slid, the magnitude of sliding is amplified by the linkage 158, then to be transmitted to the positioning arm 60 or ink replenishing unit 48.

In each cam unit 144, positions and formation of the cam 146 for forward movement and the cam 148 for backward movement are determined such that the forward cam 146 and the backward cam 148 can advance or retreat the corresponding positioning arm 60 or ink replenishing unit 48 with a predetermined timing. The stationary frame 52 is provided with a sensor (not shown) which detects a rotational position of the cam unit 144. On the basis of a rotational angle of the cam unit 144 which is detected by the sensor, the control circuit which is not shown in figures drives the drive motor 128 to set the initial position of the cam unit 144 or control the rotational angle thereof.

Figure 14:
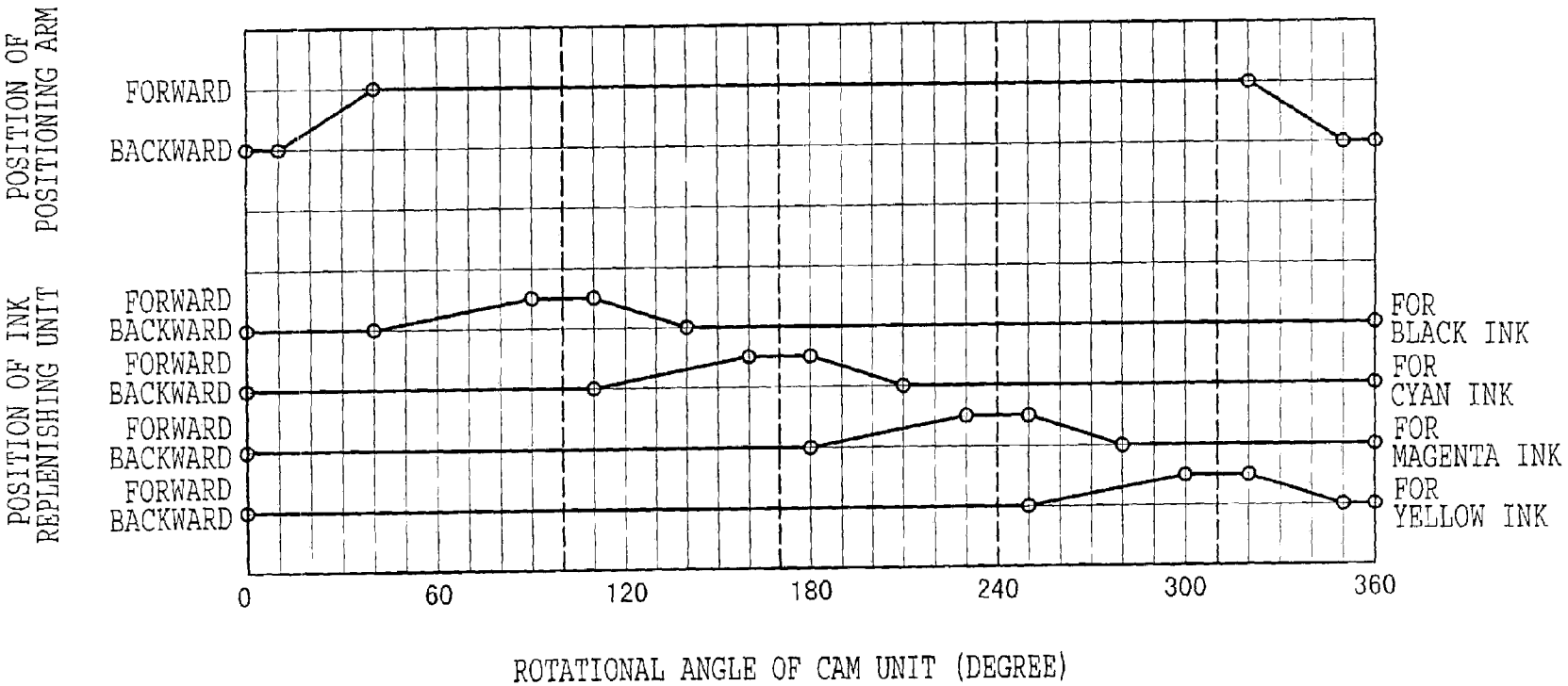
FIG. 14 is a chart showing a relationship among an angle of a cam unit, a position of a positioning arm, and a position of an ink replenishing unit in an ink replenishing device according to an embodiment of the invention.

As shown in FIG. 14, when the cam unit 144 is rotated by receiving the torque from the normal rotation of the drive motor 128, first, in the case that the rotational angle of the cam unit 144 has reached 10° (see FIG. 5), the positioning arm 60 is advanced by the forward cam 146 of the cam unit 144 corresponding to the positioning arm 60. In case that the rotational angle of the cam unit 144 has reached 40°, as shown in FIG. 6, the positioning arm 60 is located at the most forward position, and then the positioning arm 60 is maintained at this position until the rotational angle reaches 320°.

Figure 15B:
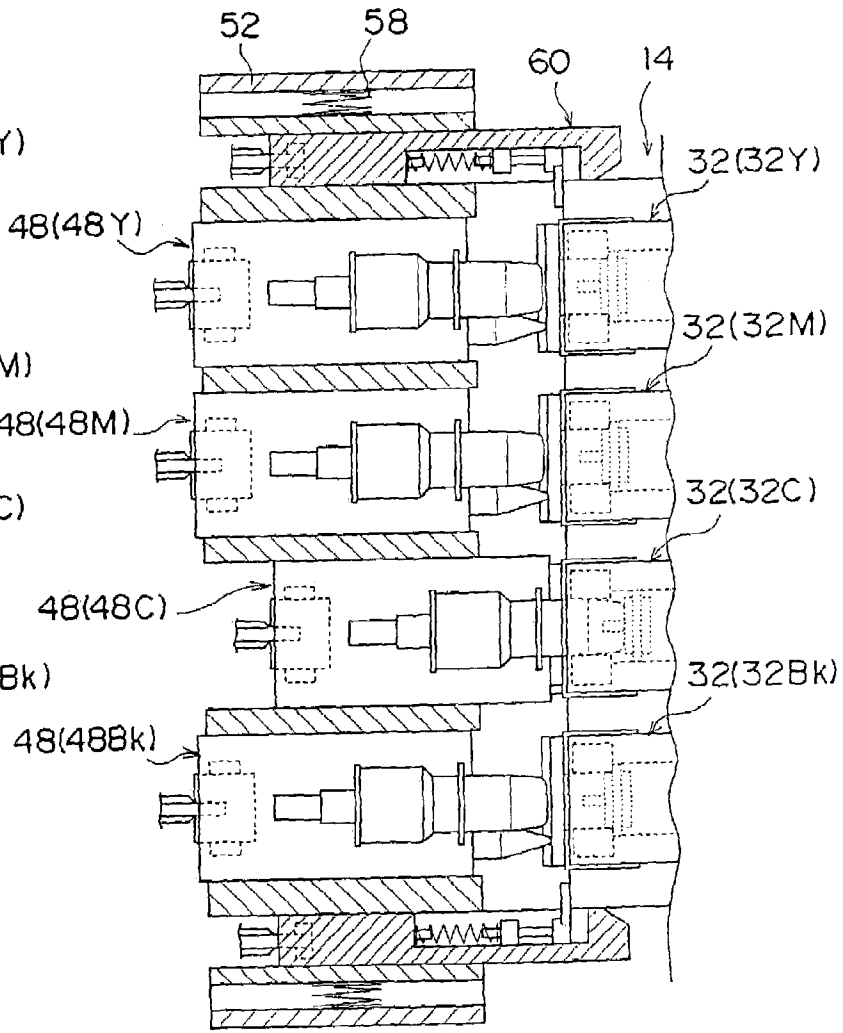
FIG. 15A and FIG. 15B show a state which each ink replenishing unit has advanced to the corresponding ink replenishing position in an ink replenishing device according to an embodiment of the invention respectively.
Figure 15A:
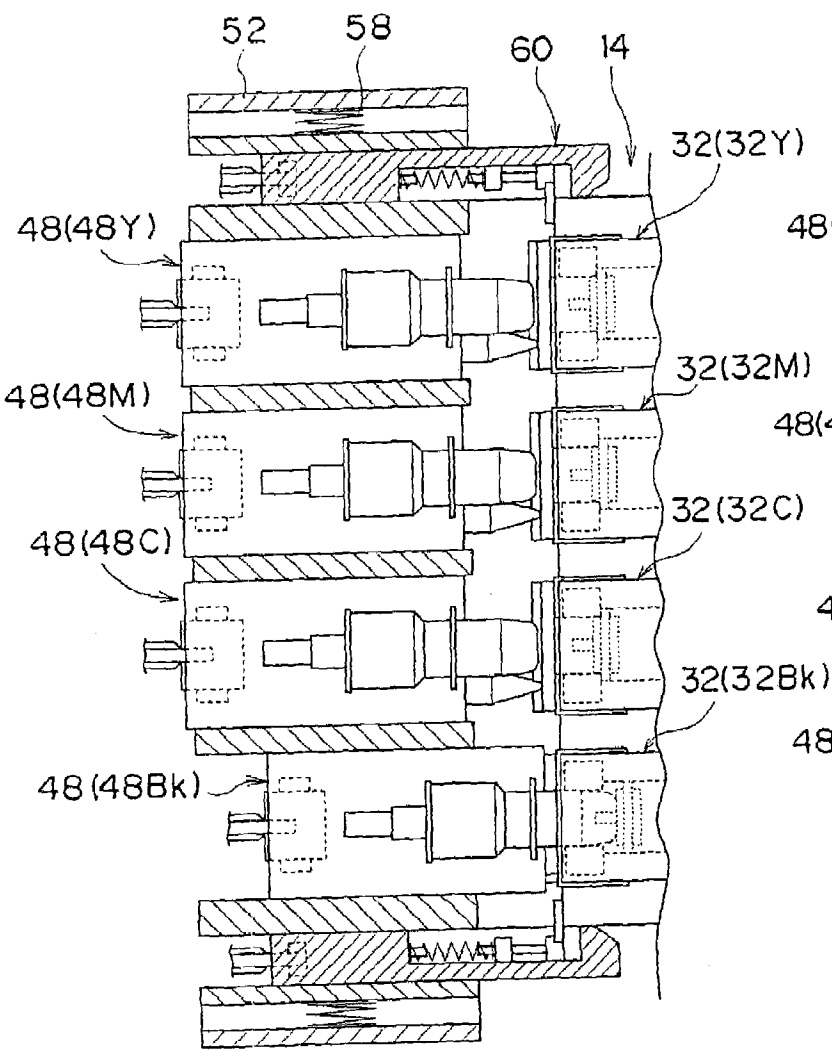

When the rotational angle of the cam unit 144 has reached 40°, the ink replenishing unit 48Bk for the black ink starts to advance by the action of the forward cam 146 of the cam unit 144 corresponding to the ink replenishing unit 48Bk. When the rotational angle has reached 90°, as shown in FIG. 15A, the ink replenishing unit 48Bk is located at the most forward position, and then the ink replenishing unit 48Bk is maintained at this position until the rotational angle reaches 110°. At this stage, even if the rotation of the driving motor 128 is stopped or the driving motor 128 is reversely rotated, since the cam unit 144 is not rotated, the ink replenishing unit 48Bk can be maintained at this position until the drive motor 128 is normally rotated next time.

Figure 16B:
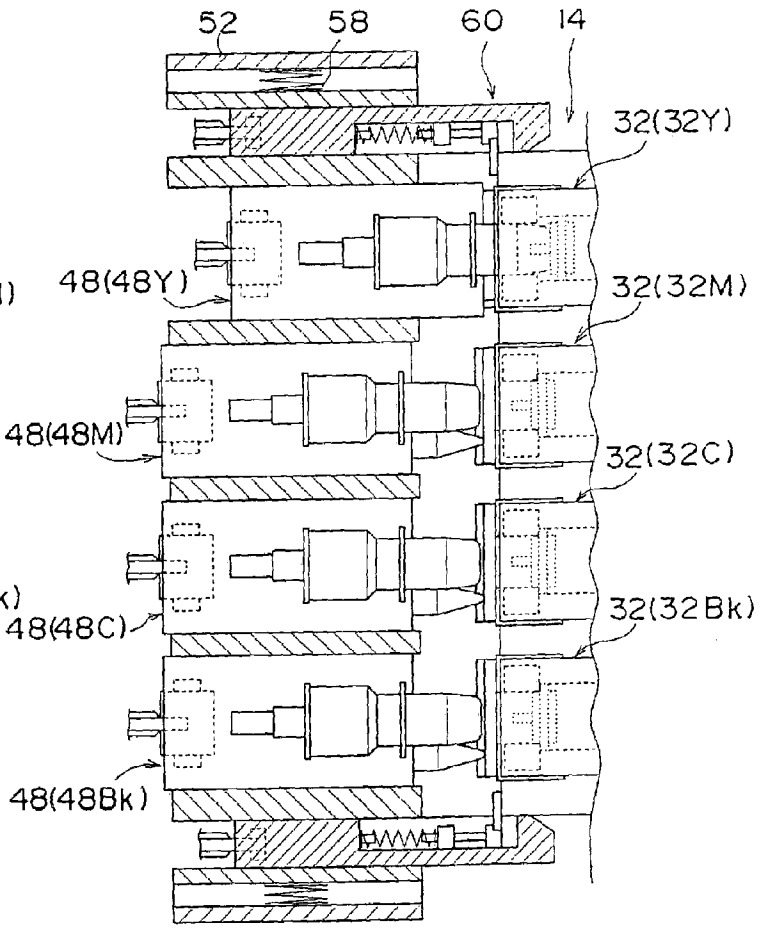
FIG. 16A and FIG. 16B show a state which each ink replenishing unit has advanced to the corresponding ink replenishing position in an ink replenishing device according to an embodiment of the invention respectively.
Figure 16A:
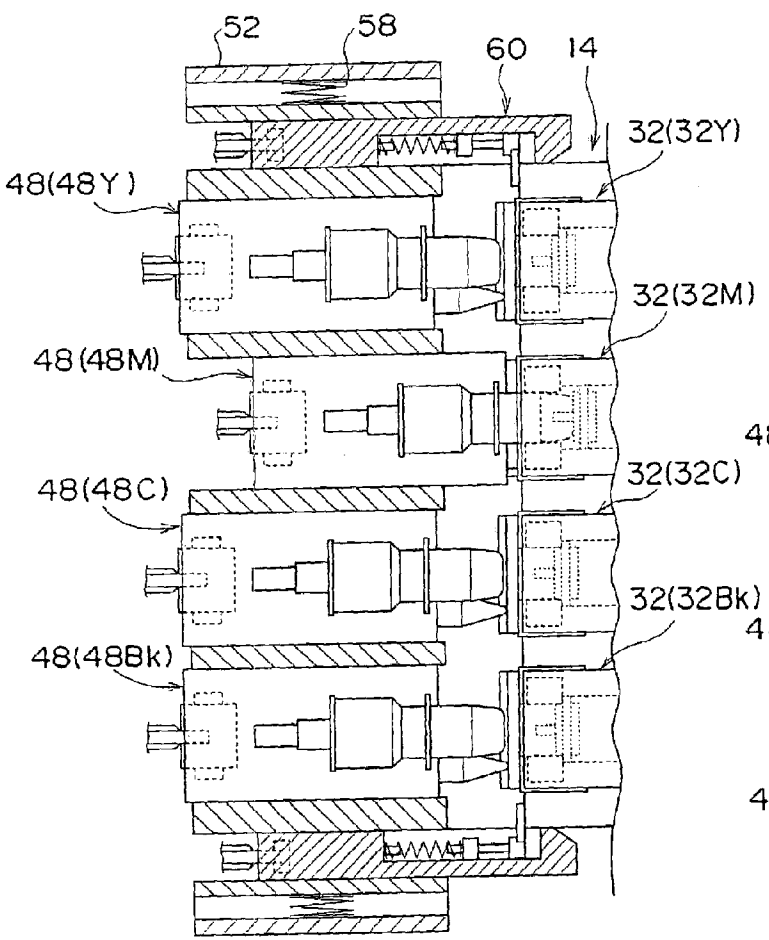

When the cam unit 144 is further rotated, the ink replenishing unit 48Bk starts to retreat by the action of the backward cam 148. When the rotational angle reaches 140°, the ink replenishing unit 48Bk is retreated to the initial position. When the rotational angle has reached 110° (i.e., at the same time when the ink replenishing unit 48Bk starts to retreat), the ink replenishing unit 48C for the cyan ink starts to advance by the action of the forward cam 146 of the cam unit 144 corresponding to the ink replenishing unit 48C, and the ink replenishing unit 48C is located at the most forward position at the rotational angle of 160°. Then, the most forward position is maintained during a period in which the rotational angle is in the range from 160° to 180° (see FIG. 15B). The ink replenishing unit 48C starts to retreat at 180° by the action of the backward cam 148. When the rotational angle has reached 210°, the ink replenishing unit 48C is retreated to the initial position. Accordingly, the ink replenishing unit 48C for cyan carries out the same actions as the ink replenishing unit 48Bk did, later than the ink replenishing unit 48Bk by the rotational angle of 70°. After that, in the same way, the ink replenishing unit 48M for the magenta carries out the forward and backward movement, later than the ink replenishing unit 48C for the cyan ink by the rotational angle of 70° (see FIG. 16A). The ink replenishing unit 48Y for yellow ink carries out the forward and backward movement, later than the ink replenishing unit 48M for the magenta ink by the rotational angle of 70° (see FIG. 16B). As described above, in the ink replenishing device 46 of the embodiment, since a predetermined phase difference (70° in the present embodiment) is provided to the cam unit 144 corresponding to each ink replenishing unit 48, each of the ink replenishing units 48 can be independently advanced and retreated relative to the corresponding sub ink tank 30.

As shown in FIG. 13, when the driving motor 128 is reversely rotated, the oscillating arm 140 constituting the clutch unit 134 oscillates in the clockwise direction and the output side gear 142 meshes with the row of gears 132 for driving the pump. As a result, the torque of the drive motor 128 is transmitted to a pump shaft 166 constituting a pump unit 164.

As shown in FIG. 2, the pump unit 164 is formed to have four roller pumps 168 corresponding to the tube for exhausting 126 extending from each ink replenishing unit 48. As shown in FIG. 3, each roller pump 168 has a rotating board 170 which rotates integrally with the pump shaft 166 and one or more rollers 172 (two rollers are diagonally provided in the present embodiment) which is arranged in the vicinity of the outer periphery of the rotating board 170. On the other hand, the tube for exhausting 126 is placed so as to partially surround a periphery of the rotating board 170. The roller 172 locally presses the tube for exhausting 126. Accordingly, when the rotating board 170 rotates in clockwise direction in FIG. 3, the roller 172 moves so as to squeeze the tube for exhausting 126 and exhausts fluid (air in the present embodiment) in the tube for exhausting 126 from the other end of the tube for exhausting 126 to the air. In each roller pump 168, a mounting angle of each rotating board 170 is determined so that the rollers 172 are arranged as a whole with an equal space therebetween, as viewed along an axial direction of the pump shaft 166. In the present embodiment, since the four roller pumps 168 are arranged, as is seen in FIG. 3, when each of rotating boards 170 is arranged with the mounting angle shifted by 45°, the rollers 172 are arranged as a whole with the equal space therebetween (with the center angle being 22.5 degree) as viewed along the pump shaft 166. This allows resistance (in particular, rotational resistance which is generated as a result of the roller 172 being pushed by reaction force of the tube for exhausting 126) acting on the pump unit 164 to be dispersed, so that the pump unit 164 rotates smoothly.

The forward and backward movements of the ink replenishing unit 48 and the drive of the pump unit 164, as a result of normal or reverse-direction drive by the drive motor 128, is controlled by the control circuit which is not shown so that the timing is not overlapped with the maintenance actions of the maintenance station 20.

Next effect of the ink replenishing device 46 and the ink jet recording apparatus 12 of the present embodiment and an ink replenishing method with the ink replenishing device 46 will be described.

The ink droplet is ejected from the recording head 28 according to the image information, and the recording head carriage 14 moves in the main scanning direction and the recording medium P moves in the sub-scanning direction, respectively, whereby the image is recorded on the recording medium P. Since the ink droplet is generated from the ink which is supplied from the sub ink tank 30 to the recording head 28, the ink in the sub ink tank is decreased.

When the recording head 28 becomes a given state in which the recording head 28 requires the maintenance, the control circuit which is not shown moves the recording head carriage 14 to the home position, makes the maintenance station 20 approach the recording head 28, and carries out the predetermined maintenance operation. This allows the recording head 28 to be recovered to an optimum state for ejecting ink, and consequently the optimum state for ejecting ink is always maintained, so that the high quality image can be recorded on the recording medium P.

When the ink quantity sensor 40 detects that the ink in the specific sub ink tank 30 has been decreased to the extent of a predetermined level and sends the information to the control circuit which is not shown, the control circuit moves the recording head carriage 14 to the ink replenishing position. At this stage, the maintenance station 20 is controlled by the control circuit so as not to be operated.

The control circuit operates to normally rotate the driving motor 128 so that the cam unit 144 is rotated by an angle corresponding to the specific sub ink tank 30. For example, in the case that the black ink is replenished to the sub ink tank 30Bk, as can be seen from FIG. 14, the drive motor 128 is normally rotated so that the rotational angle of the cam unit 144 is in a range of 90° to 110° (inclusive of both 90° and 110°).

At this stage, when the rotational angle of the cam unit 144 has reached 10°, the positioning arm 60 starts to advance. In the case that the recording head carriage 14 is not aligned with the guide frame body 54 in the widthwise direction, one of the tapered faces 62 of the positioning arm 60 contacts the corner portion of the recording head carriage frame 26. In this state, when the positioning arm 60 further approaches the recording head carriage 14, since the movement in this approaching direction is converted into the movement in the widthwise direction of the guide frame body 54, the guide frame body 54 moves in the widthwise direction against the elastic force of the helical compression spring 58. Then, when the positioning arm 60 further approaches the recording head carriage 14, as shown in FIG. 5, the side face 26C of the recording head carriage frame 26 is brought into contact with the inside face 60A of the positioning arm 60, whereby the recording head carriage 14 and the guide frame body 54 are correctly positioned or aligned in the widthwise direction. For example, even if a stop position (ink replenishing position) of the recording head carriage 14 is slightly shifted or any position shift caused by other various factors has been generated, such position shift is eliminated and the four ink replenishing units 48 are integrally positioned relative to the corresponding sub ink tank 30.

When the positioning arm 60 further advances and pressing piece 66 contacts the recording head carriage frame 26, the positioning arm 60 receives the urging force of the helical compression spring 68 to press the recording head carriage 14. This allows the recording head carriage 14 to be held tight between the pressing piece 66 and the guide member 18, so that the recording head carriage 14 is not carelessly rattled.

At this point, as can be seen from FIG. 14, the rotational angle of the cam unit 144 is 40°, and the forward cam follower 152 is pressed in the direction of approaching the sub ink tank 30 by the forward cam 146 of the cam unit 144 corresponding to the black ink, so that the ink replenishing unit 48Bk advances and starts to approach the sub ink tank 30Bk. During advancing (i.e., in a state in which the positioning pin 78 has not entered the positioning port 80 yet), the guide pin 88 moves in the support portion 90A, and the ink replenishing unit 48 slides without rattle within the accommodating portion 70 of the guide frame body 54.

Figure 7:
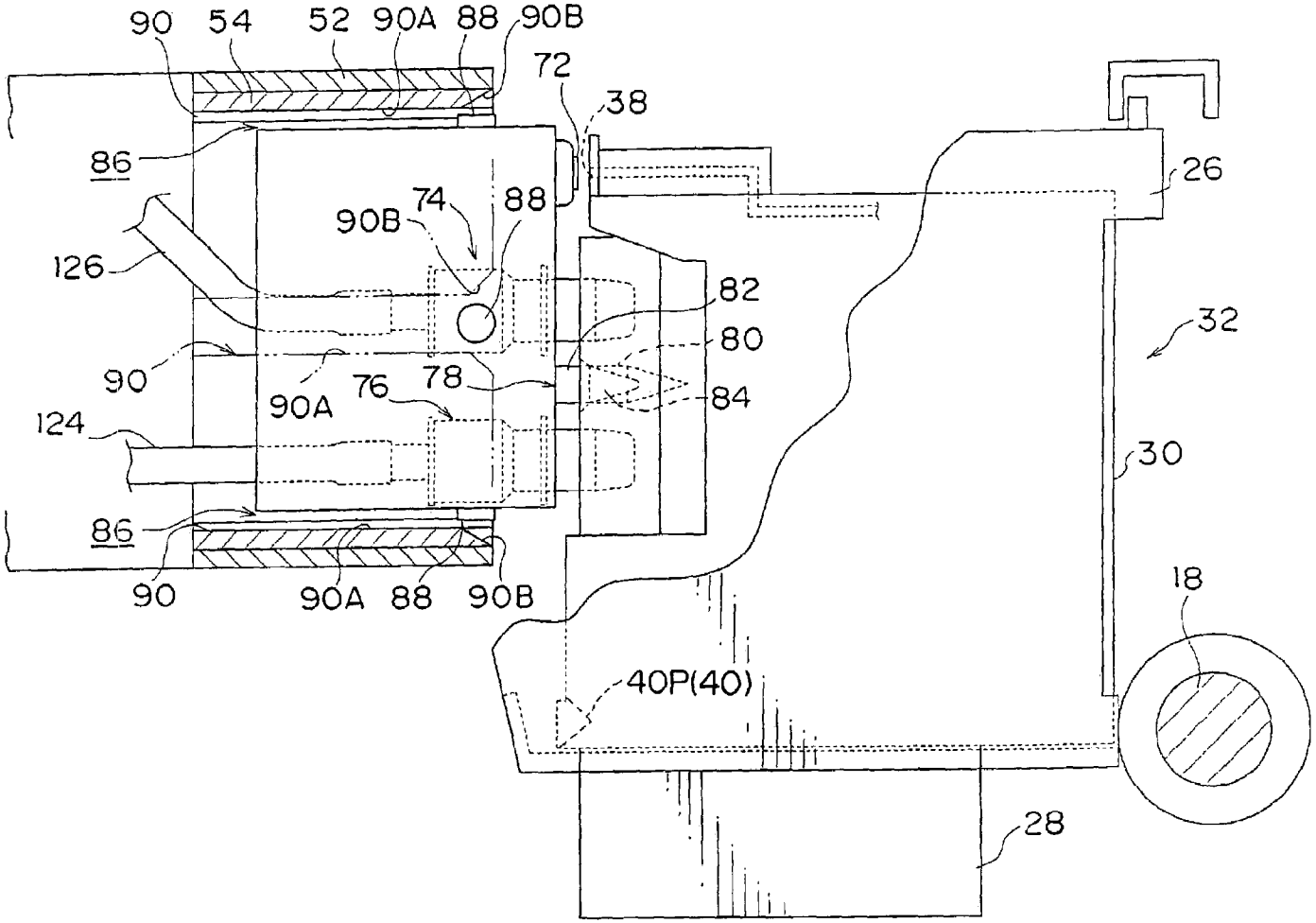
FIG. 7 is a partially ruptured plan view showing in enlarged dimension an ink replenishing unit of an ink replenishing device and a sub ink tank of an ink jet recording apparatus according to an embodiment of the invention at a state of the ink replenishing unit on its way to advance.

As shown in FIG. 7, the positioning pin 78 starts to be inserted into the positioning port 80 when the ink replenishing unit 48 approaches the sub ink tank 30. At this point, as can be seen from FIG. 17, in a state before inserting, the communicating hole 96 is sealed with the packing 104 in the main body of the pipe 94 (see FIG. 10A), and the main body of the pipe 94 is closed and sealed. Similarly, in the ink replenishing opening 44, the valve 118 is closely contacted with the projection portion 114C of the gasket 114, so that the communication of the inner space with the atmosphere is obstructed.

Figure 8:
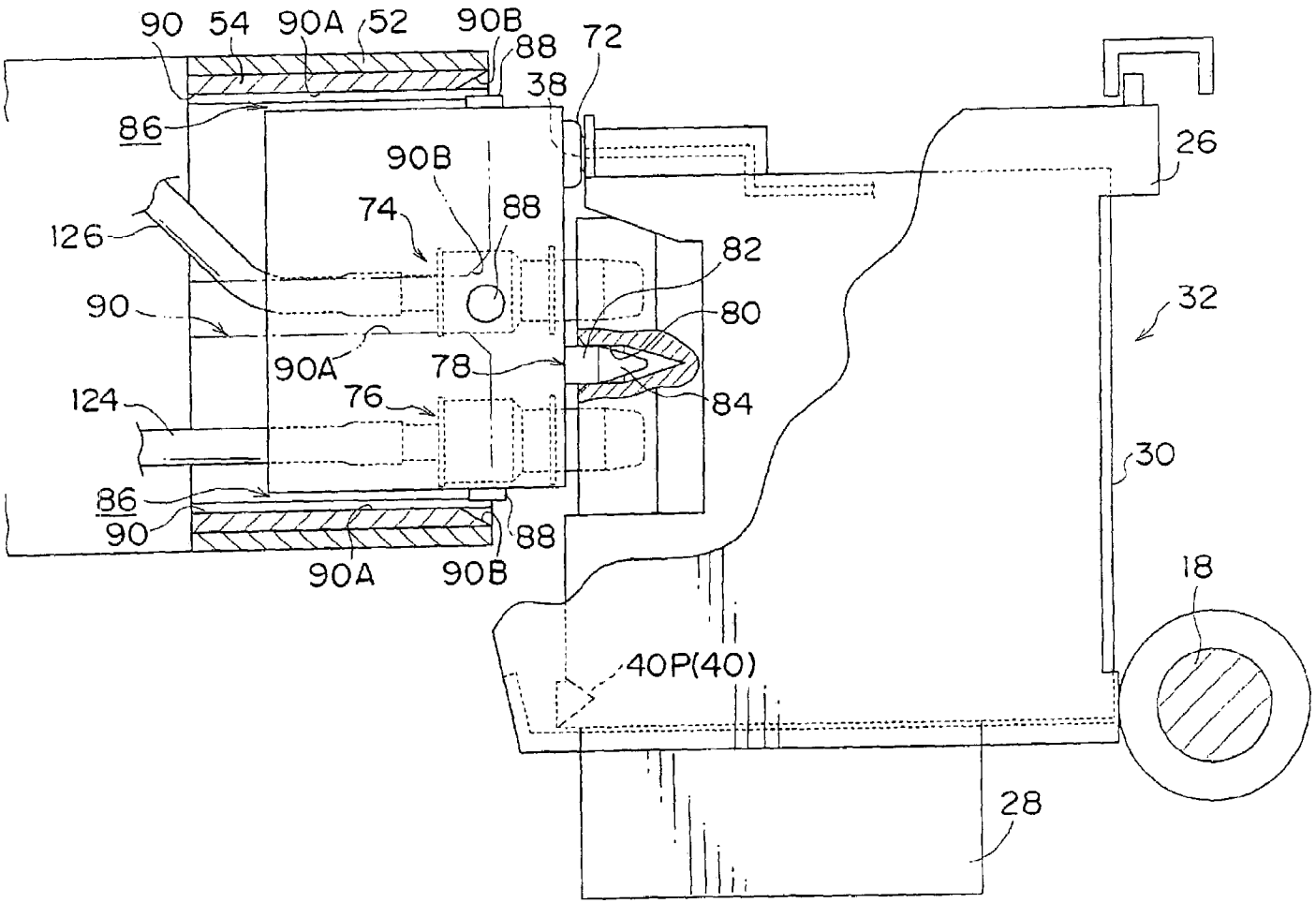
FIG. 8 is a partially ruptured plan view showing in enlarged dimension an ink replenishing unit of an ink replenishing device and a sub ink tank of an ink jet recording apparatus according to an embodiment of the invention with the ink replenishing unit reached a supply position.

Since the guide portion 84 at the nose or tip end of the positioning pin 78 is formed to be the taper shape, when the positioning pin 78 is inserted into the positioning port 80, even if the center of the positioning pin 78 shifts off the center of the positioning port 80, the positioning pin 78 reliably enters the positioning port 80. At this stage, since the guide pin 88 reaches the width-wide portion 90B and the gap is formed between the guide pin 88 and the width-wide portion 90B. As a result, in the accommodating portion 70, the ink replenishing unit 48 can be moved within a given range in the up and down directions and the widthwise direction. When the ink replenishing unit 48 further approaches the sub ink tank 30, the center of the positioning pin 78 and the center of the positioning port 80 are gradually moved by the guide portion 84 in the direction which the center of the positioning pin 78 and the center of the positioning port 80 are coincided. When the positioning portion 82 reaches the positioning port 80, as shown in FIG. 8, the center of the positioning pin 78 coincides with the center of the positioning port 80, whereby the specific ink replenishing unit 48 and the sub ink tank 30 corresponding thereto are correctly positioned.

Then, as can be seen from FIG. 17, when the port for replenishing ink 36 advances, the atmosphere communicating opening 38 is closed by the cap 72. As can be seen from FIGS. 10 and 17, the port for replenishing ink 36 further advances and the nose or the tip end of the main body of the pipe 94 enters the ink replenishing opening 44 (start of a pipe inserting process), and the valve abutting portion 110 contacts the valve projection portion 122. At this stage, when the main body of the pipe 94 is further inserted, the valve abutting portion 110 and the valve projection portion 122 are pressed with each other. As the helical compression spring 108 in the main body of the pipe 94 has the spring constant which has been set to be smaller relative to that of the helical compression spring 120 in the ink replenishing opening 44, only the main body of the pipe 94 advances while the helical compression spring 108 is being compressed (strictly speaking, valve body 98 is at rest or unmoved at this stage), whereby the communicating hole 96 is opened by the valve body 98. At this stage, the lip portion 114B is not in contact with the outer peripheral portion the main body of the pipe 94.

When the main body of the pipe 94 is inserted into the ink replenishing opening 44, as shown in FIG. 10C, as the nose portion of the main body of the pipe 94 is brought into contact with the valve 118, the helical compression spring 120 is pressed by the main body of the pipe 94 through the valve 118 to starts to be compressed (the valve body 98 and the main body of the pipe 94 integrally enter the ink replenishing opening 44, while the valve body 98 and the main body of the pipe 94 are retained so that a substantially constant distance is maintained therebetween relative to each other). As a result, the valve 118 separates from the projection portion 114C of the gasket 114 to start to create an opening therebetween. Even in this state, as can be seen from FIG. 17, the lip portion 114B is not contacted with the outer peripheral portion of the main body of the pipe 94. Since the inside of the sub ink tank 30 is maintained in the negative pressure, the air is sucked from the gap between the outer peripheral portion of the main body of the pipe 94 and the lip portion 114B. Particularly, at this stage, as the atmosphere communicating opening 38 of the sub ink tank 30 is sealed by the cap 72, undesirable entry of the air from the atmosphere communicating opening 38 into the sub ink tank 30 is prevented. Therefore, the air is securely sucked from the gap between the outer peripheral portion of the main body of the pipe 94 and the lip portion 114B. With this suction, the ink which is remained in or adhered to the outer peripheral portion of the main body of the pipe 94 or the inside of the ink replenishing opening 44 is also sucked into the sub ink tank 30. This sucking operation of the ink into the sub ink tank 30, continues, as shown as "Sucking Action of Ink" in FIG. 17, from start of the opening operation of the ink replenishing opening 44 till the sealing of the outer peripheral portion of the main body of the pipe 94.

As shown in FIG. 10D, while the main body of the pipe 94 is advanced in the most inside position, the outer peripheral portion of the main body of the pipe 94 is closely contacted with the lip portion 114B. The ink replenishing unit 48 is located at the ink replenishing position, the connection between the port for replenishing ink 76 and the ink replenishing opening 44 of the sub ink tank 30 is finished to be liquid-communicated, and the ink flow or channel from the main ink tank 50 to the sub ink tank 30Bk is formed. At the same time, the connection between the port for exhausting 34 and the exhaust opening 42 is completed (completion of the pipe inserting process). Accordingly, when the drive motor 128 is normally rotated to set the cam unit 144 at the specific rotational angle, the specific the ink replenishing unit 48 to be connected with the sub ink tank 30 corresponding thereto.

The drive motor 128 is reversely rotated by the control circuit which is not shown. The oscillating arm 140 of the clutch unit 134 oscillates in the clockwise direction in FIG. 12. As shown in FIG. 13, the transmission of the torque of the drive motor 128 is switched so that the torque is transmitted to the row of gears 132 for driving pump instead of the row of gears 130 for displacing the ink replenishing unit. Consequently, the roller pump 168 constituting the pump unit 164 is driven, while the position of the ink replenishing unit 48Bk is held at ink replenishing position, whereby air inside the sub ink tank 30Bk is exhausted from the exhaust opening 42 of the sub ink tank 30Bk by the ink replenishing unit 48Bk. At this stage, since the atmosphere communicating opening 38 of the sub ink tank 38Bk is sealed by the cap 72, any accidental entry of the air from the atmosphere communicating opening 38 into the sub ink tank 30Bk is prevented, and the air is securely exhausted from the sub ink tank 30Bk. With respect to other the ink replenishing units 48 which have not advanced to the ink replenishing positions thereof, although the corresponding roller pump 168 is driven, the resistance against the drive of the roller pump 168 is not generated because the port for exhausting 74 is opened.

Since the control circuit reversely rotates the drive motor 128 only for a predetermined time, a predetermined amount of the ink is supplied to the sub ink tank 30. This time period during which the drive motor 128 is reversely rotated may be set beforehand at a fixed value or determined by feedback control on the basis of the ink quantity information from the ink quantity sensor 40.

Then, the control circuit normally rotates the drive motor 128. The oscillating link 160 oscillates in the counterclockwise direction in FIG. 13. As shown in FIG. 12, the torque of the drive motor 128 is retransmitted to the row of gears 130 for displacing the ink replenishing unit, so that the cam unit 144 is rotated. As can be seen from FIG. 14, when the rotational angle of the cam unit 144 reaches 110°, the ink replenishing unit 48Bk starts to be retreated. And then the valve 118 is brought into close contact with the projection portion 114B of the gasket 114, and the communicating hole 96 is sealed by the packing 104.

At this point, as can be seen from FIG. 17, since the main body of the pipe 94 starts to retreat at the ink replenishing opening 44 (start of a pipe drawing-out process), first the outer peripheral portion of the main body of the pipe 94 is separated from the lip portion 114B to open the ink channel into the atmosphere. Accordingly, in the same manner as described above, the ink which is remained in or adhered to the outer peripheral portion of the main body of the pipe 94 or the inside of the ink replenishing opening 44 is also sucked into the sub ink tank 30, as the air is absorbed from the gap between the outer peripheral portion of the main body of the pipe 94 and the lip portion 114B by the negative pressure in the sub ink tank 30. Then, the valve 118 is slid by the elastic force of the helical compression spring 120 to approach the projection portion 114C of the gasket 114. When the valve 118 returns to the initial position to contact closely with the projection portion 114C, the valve body 98 in the main body of the pipe 94 receives the elastic force of the helical compression spring 108 to be slid, and the valve body 98 moves toward the communicating hole 96. The valve body 98 returns to the initial position to seal the communicating hole 96, and the main body of the pipe 94 is drawn out from the ink replenishing opening 44 (completion of the drawing-out process). Finally, the cap 72 is separated from the atmosphere communicating opening 38 and the sub ink tank is opened into atmospheric pressure.

Further, when the drive motor 128 rotates normally and the rotational angle of the cam unit 144 reaches 140°, the retreat of the ink replenishing unit 48Bk is completed, and the ink replenishing unit 48Bk returns to the initial position.

With the aforementioned operations, the ink replenish operation for the sub ink tank 30Bk corresponding to the black ink is completed. However, in case that the ink replenish for other sub ink tanks 30 is further required, the control circuit further normally rotates the drive motor 128 so that the rotational angle of the cam unit 144 is set at the angle corresponding to the sub ink tank 30 which requires the ink supply. For example, in the case that the ink is supplied to the sub ink tank 30C corresponding to the cyan ink, the drive motor 128 is normally rotated until the rotational angle of the cam unit 144 is set to be not lower than 160° nor more than 180°, so that, the ink replenishing unit 48C is set to be the ink replenishing position, as shown in FIG. 15B. The roller pump 168 is driven by reversely rotating the drive motor 128 with this state, whereby the ink is replenished to the sub ink tank 30C. After replenishing the predetermined quantity of the ink, the control circuit normally rotates the drive motor 128, makes the ink replenishing unit 48C retreat, and returns the ink replenishing unit 48C to the initial position.

In case that the ink replenishing to the sub ink tank 30C is not required, by preventing the drive motor 128 from being rotated reversely such that only the ink replenishing unit 48C advances and retreats and the pump unit 164 is not driven, the ink will not be replenished to the sub ink tank 30C. However, even in the case in which the ink is being replenished to the sub ink tank 30C, as the inserting and drawing-out actions to the ink replenishing opening 44, of the main body of the pipe 94, is carried out by the forward and retreat of the ink replenishing unit 48C, the ink which is remained in or adhered to the outer peripheral portion of the main body of the pipe 94 or the inside of the ink replenishing opening 44 is sucked into the sub ink tank 30 by utilizing the negative pressure in the sub ink tank 30.

When the ink replenishing operation to the desired sub ink tank 30 is completed, as can be seen from FIG. 14, finally (strictly, simultaneously with the retreating operation of the ink replenishing unit 48Y), the positioning arm 60 is retreated by the backward cam corresponding to the positioning arm 60, and the sub ink tank 30 returns to the initial position. In the way described above, all the actions replenishing the ink to the sub ink tank 30 are completed.

As can be seen from the above-described description, in the present embodiment, the ink replenishing unit 48 corresponding to the specific sub ink tank 30 which requires the ink replenishing among the plurality of sub ink tanks 30 is selectively moved to the replenishing position, and the ink is replenished, for each color, to the sub ink tank 30. When the main body of the pipe 94 is inserted and drawn out in the ink replenishing operation, the ink which is remained in or adhered to the outer peripheral portion of the main body of the pipe 94 or the inside of the ink replenishing opening 44 is sucked into the sub ink tank 30, regardless that the ink is actually replenished or not. Therefore, the ink leakage can reliably be prevented and so-called ink dirt can be prevented. Furthermore, in the case that the ink is slightly leaked out, the leaked ink is sucked and held by the ink absorber 186 placed below the gasket cover 112. Therefore, scatter and spread of the leaked ink can be prevented and the ink dirt can more reliably be prevented than the conventional model.

Table 1 shows the ink leakage quantity in the vicinity of the ink replenishing opening 44 after the ink replenishing, the ink leakage quantity being the value measured, in the ink replenishing device of the present embodiment, for one ink replenishing operation, after the image recording to 24000 sheets of paper (size of A4, printing duty of 5%), which task is regarded as terminating the product life of the recording head 28.

TABLE 1

| | Average Value of Ink leakage Quantity (mg) | | |
|---|---|---|---|
| | Per Ink replenishing Operation | After Image Recording to 24000 Sheets of Paper (Size of A4, Printing Duty of 5%) | Reduction Rate of Ink Leakage Quantity (Comparative Example = 100%) |
| Comparative Example 1 | 1.23 | 406 | 100% |
| The present Embodiment | 0.378 | 125 | 31% |

In Table 1, the values which are shown as the comparative example 1 are the ink leakage quantity in the ink replenishing device whose configuration is the same as the present embodiment except that the to-be-pressed piece 184 of the embodiment is not formed. In the ink replenishing opening 44 of the comparative example 1, as can be seen from FIG. 17, the periphery of the main body of the pipe 94 is at first closely contacted with the lip portion 114B and then the ink channel is formed in the pipe inserting process. Accordingly, the ink which is remained in or adhered to the outer peripheral portion of the main body of the pipe 94 or the inside of the ink replenishing opening 44 is not sucked into the sub ink tank 30 by the negative pressure in the sub ink tank 30. Further, in the case of the configuration of the comparative example 2 shown by the dash-double dot line in FIG. 17, the structure of the comparative example 2 is similar to that of the comparative example 1 in that the outer peripheral portion of the main body of the pipe 94 is at first brought into close contact with the lip portion 114B and then the ink channel is formed. Accordingly, it is reliably assumed that the ink leakage quantity of the comparative example 2 will be almost the same value as that of the comparative example 1.

In this measurement, the twenty recording heads are used for evaluation. "Average Value" of "Average Value of Ink Leakage Quantity" in Table 1 shows the average value of the values obtained from the twenty recording heads. In the actual measurement, the quantity of the leaked ink is measured for the image recording to 24000 sheets of paper, which image recording is supposed to terminate the product life of the recording head, and the measured quantity of the leaked ink is divided by the total number of the ink replenishing operations (330 times) to obtain the ink leakage quantity of "per ink replenishing operation".

As can be seen from Table 1, in the present embodiment, the ink leakage quantity is decreased to 31%, as compared with the comparative example 1.

According to the result, the quantity of ink absorbable by the ink absorber 186 can be set properly. For example, in the case that a porous body having internal volume of 0.4 ml and absorption ratio of 40% (or more) is used, the quantity of ink absorbable by the ink absorber 186 is 0.16 ml (or more). Consequently, in the case of the present embodiment, the ink which has leaked out is securely absorbed and held throughout the product life of the recording head 28. Examples of a porous body satisfying such conditions include Sunfine AQ (trademark, manufactured by Asahi Chemical Industry Co., Ltd.) which is a hydrophilic polyolefin porous body. However, the material of the porous body is not limited to this example.

In the invention, the specific structure for replenishing the ink to the sub ink tank 30 is not limited to the above-mentioned example. Other structures, for example, a structure in which the ink replenishing unit 48 is arranged above the sub ink tank 30 and the ink is dropped or flowed down from the ink replenishing unit 48 to the sub ink tank 30 utilizing gravity caused by a difference in the elevated position between the ink replenishing unit 48 and the sub ink tank 30 may be used. Alternatively, a structure in which the ink is pressurized to be forcefully sent into the sub ink tank 30 may be used.

The structure for evacuating the sub ink tank to a negative pressure is not limited to the above-described roller pump 168, either. However, use of the roller pump 168 is advantageous because the inside of the sub ink tank 30 can reliably be evacuated in a relatively short time, to a negative pressure, with a simple device. Moreover, the roller pump can be used without converting the rotational movement of the drive motor 128 into other motion such as linear motion, which is highly efficient.

The opening means of the invention is not limited to the to-be-pressed piece 184 which is provided in the valve 118. That is, in the inserting operation of the main body of the pipe 94, it suffices that the opening means can open the ink channel to the atmosphere before the main body of the pipe 94 is brought into contact with the lip portion 114B. For example, a pressing portion such as a pressing piece which presses the valve 118 at the initial stage of the inserting operation of the main body of the pipe 94 may be provided at the tip end or the nose of the main body of the pipe 94 or the tip end of the valve abutting portion 110. A structure in which the vicinity of the tip end of the main body of the pipe 94 has the smaller outer diameter than other portions of the main body of the pipe 94 or has the larger inner diameter than the lip portion 114B, so that the timing when the main body of the pipe 94 is brought into contact with the lip portion 114B is delayed, may be used for the opening means of the invention.

In the above-described explanation, the opening means is provided only at the port for replenishing ink 36. However, if necessary, the opening means may also be provided at the port for exhausting 34. That is, when a structure is selected in which the ink level might reach the port for exhausting 34 in the sub ink tank 30, it is preferable that the opening means is also provided in the port for exhausting 34 in order that the ink leakage from the vicinity of the exhaust opening 42 is prevented. On the contrary, a structure in which the ink level does not reach the port for exhausting 34 in the sub ink tank 30, as in the present invention, is preferable because, by providing the opening means only at the port for replenishing ink 36, there is no possibility that the air is undesirably sucked from the exhaust opening 42, when the residual ink in the vicinity of the ink replenishing opening 44 is sucked into the sub ink tank 30, and the sucking force of the residual ink is weakened.

In the invention, the types of the applicable ink are not particularly limited. If the ink contains constituents such as water which is easily dried by more than a predetermined quantity, the ink absorber 186 which has absorbed the ink is relatively quickly dried, and eventually, the ink absorber 186 can substantially absorb a larger amount of ink. For example, even if the ink jet recording apparatus 12 is used for longer than its due product life, the ink absorber 186 can still absorb the ink in a sufficient manner. For example, a water-based ink, which is expected to evaporate by the amount of 70%, can be used preferably.

The specific type of the material of the ink absorber 186 is not particularly limited, as long as the material is a porous body constituted of a porous material which can absorb ink. For example, the ink absorber 186 may be formed by sintering the powder of polyurethane resin. The powder of polyurethane is preferable because this material allows molding with high molding precision and maintains the shape in a stabele manner after molding. The absorber 186 may be formed of other materials such as polyuretane foam, fibrous felt or the like.

The ink holding member of the invention is not limited to the ink absorbers 186 described above. For example, a structure in which a container in the shape of a dish or a boat is formed by a material resistant to ink and the ink is stored in the container may be used. However, when the ink is simply reservoired, there is a possibility that the ink accidentally leaks due to a change in an attitude of the ink jet recording apparatus 12 and the like. Accordingly, it is preferable that the ink holding member is formed of the above-described porous body or the porous body is placed in at least a portion of the container so as to absorb the ink.

As described above, in short, the invention can reliably prevent the ink dirt because the invention adopts the above-described configuration.

What is claimed is:

1. An ink replenishing device which replenishes ink from a main ink tank to a sub ink tank, wherein ink form the sub ink tank is supplied to a recording head which ejects an ink droplet to a recording medium based on image information and the ink being reservoired in the sub ink tank, the device comprising:

a first connecting member which is provided in the main ink tank;

a second connecting member which is provided in the sub ink tank and when connected to the first connecting member constitutes an ink channel;

a sealing member which brings the first connecting member and the second connecting member into close and sealing contact with each other in a connected state thereof;

an opening and closing member which is provided in the second connecting member and able to open/close the ink channel; and opening means for opening the ink channel to atmosphere by using the opening and closing member in a connecting operation of the first connecting member and the second connecting member.

2. An ink replenishing device according to claim 1, wherein the opening means opens the ink channel to the atmosphere before the first connecting member and the second connecting member are brought into close contact with each other by the sealing member.

3. An ink replenishing device according to claim 1, wherein the opening means comprises a to-be-pressed portion which is provided in the opening and closing member and is pressed by one of the first connecting member and the sealing member to move the opening and closing member to an open position during the connecting operation.

4. An ink replenishing device according to claim 3, wherein the first connecting member includes a valve body which can open and close the ink channel inside the first connecting member, the valve body being pressed by the to-be-pressed portion during the connecting operation and slid to open the ink channel inside the first connecting member, and then the valve body pressing the to-be-pressed portion to move the opening and closing member to the open position, whereby the ink channel is opened to the atmosphere.

5. An ink replenishing device according to claim 4, wherein the valve body is urged in a direction in which the ink channel inside the first connecting member is closed and the opening and closing member is urged in a direction in which the ink channel inside the second connecting member is closed, such that the force which urges the opening and closing member is larger than the force which urges the valve body.

6. An ink replenishing device according to claim 1, wherein the opening means comprises a pressing portion which is provided in one of the first connecting member and the sealing member and presses the opening and closing member to move the opening and closing member to an open position during the connecting operation.

7. An ink replenishing device according to claim 6, wherein the first connecting member includes a valve body which can open and close the ink channel inside the first connecting member, the valve body being pressed by the opening and closing member by way of the pressing portion during the connecting operation and slid to open the ink channel inside the first connecting member, and then the valve body pressing the opening and closing member by way of the pressing portion to move the opening and closing member to the open position, whereby the ink channel is opened into the atmosphere.

8. An ink replenishing device according to claim 7, wherein the valve body is urged in a direction in which the ink channel inside the first connecting member is closed and the opening and closing member is urged in a direction in which the ink channel inside the second connecting member is closed, such that the force which urges the opening and closing member is larger than the force which urges the valve body.

9. An ink replenishing device according to claim 1, further comprising pressure reducing means for sucking air inside the sub ink tank, to reduce pressure inside the sub ink tank.

10. An ink jet recording apparatus comprising:

a recording head unit which is provided with a recording head which ejects an ink droplet to a recording medium based on image information and a sub ink tank in which ink to be supplied to the recording head is reservoired;

a main ink tank in which the ink to be replenished to the sub ink tank is reservoired beforehand; and the ink replenishing device of claim 1, which device replenishes ink from the main ink tank to the sub ink tank.

11. An ink jet recording apparatus according to claim 10, wherein the sub ink tank includes an ink holding member which is arranged in an outside vicinity of the second connecting member.

12. A sub ink tank for supplying ink to a recording head which ejects an ink droplet to a recording medium based on image information, the sub ink tank comprising:

a first connecting section through which the ink is supplied to the sub ink tank, the first connecting section being provided so as to face a port for replenishing ink of a main ink tank;

a second connecting section through which air inside the sub ink tank is exhausted, the second connecting section being provided at a same side as the first connecting section and being positioned above the first connecting section; and an ink holding member that is provided at the same side as the first connecting section and is positioned below the first connecting section.

13. A sub ink tank according to claim 12, wherein the ink holding member comprises a porous body which is made of a porous material and is able to absorb ink.

14. A sub ink tank according to claim 13, wherein the porous body is a sintered body formed by sintering powder of polyolefine resin.

15. A sub ink tank according to claim 13, wherein the porous material is polyurethane foam.

16. A sub ink tank according to claim 13, wherein the porous material is fibrous felt.

17. A sub ink tank according to claim 12, wherein the ink holding member is located apart from the ink channel.

18. An ink replenishing device, which replenishes ink from a main ink tank to a sub ink tank, comprising:

a first connecting member formed as a first conduit that is connected with the main ink tank;

a second connecting member formed as a second conduit that is connected with the sub ink tank, wherein the second connecting member is connected with the first connecting member to form an ink channel as a continuous space constituted of the first conduit and the second conduit;

pressure reducing means for sucking air inside the sub ink tank, to reduce pressure therein;

an opening and closing member that is positioned between an open position where the ink channel is formed and a closed position where the first conduit and the second conduit are separated from each other; and a sealing member that brings the first connecting member and the second connecting member into close contact with each other and seals the ink channel after the opening and closing member is moved to the open position during a connecting operation of the first connecting member and the second connecting member.

19. An ink jet recording apparatus comprising:

a recording head unit provided with a recording head which ejects an ink droplet to a recording medium based on image information and a sub ink tank in which ink to be supplied to the recording head is reservoired;

a main ink tank in which ink to be replenished to the sub ink tank is reservoired beforehand;

the ink replenishing device of claim 18, which replenishes ink from the main ink tank to the sub ink tank; and an ink holding member arranged in an outside vicinity of the first and second connecting members and constitutes a porous material which can absorb ink.

20. An ink replenishing device according to claim 18, wherein the opening and closing member slidably moves relative to the second connecting member in order to move to the open position.

* * * * *